US011746648B2

(12) United States Patent
Pye

(10) Patent No.: US 11,746,648 B2
(45) Date of Patent: Sep. 5, 2023

(54) ON DEMAND ANNULAR PRESSURE TOOL

(71) Applicant: SAUDI ARABIAN OIL COMPANY, Dhahran (SA)

(72) Inventor: Richard Mark Pye, Aberdeen (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 24 days.

(21) Appl. No.: 17/453,720

(22) Filed: Nov. 5, 2021

(65) Prior Publication Data

US 2023/0146339 A1 May 11, 2023

(51) Int. Cl.

| | |
|---|---|
| ***E21B 47/06*** | (2012.01) |
| ***E21B 34/06*** | (2006.01) |
| ***E21B 21/10*** | (2006.01) |
| ***E21B 47/10*** | (2012.01) |
| ***E21B 47/07*** | (2012.01) |

(52) U.S. Cl.

CPC ..... *E21B 47/06* (2013.01); *E21B 34/066* (2013.01); *E21B 47/07* (2020.05); *E21B 47/10* (2013.01); *E21B 2200/04* (2020.05)

(58) Field of Classification Search

CPC .... E21B 34/066; E21B 2200/04; E21B 47/06; E21B 47/07; E21B 44/00; E21B 21/10; E21B 21/08; E21B 17/00

See application file for complete search history.

(56) References Cited

U.S. PATENT DOCUMENTS 7,114,583 B2 10/2006 Chrisman
7,650,950 B2 1/2010 Leuchtenberg
7,841,425 B2 11/2010 Mansure et al.
7,866,391 B2 * 1/2011 Wardley ..... E21B 21/10 166/285
7,966,875 B2 6/2011 Proett et al.
8,627,890 B2 * 1/2014 Bailey ..... E21B 7/00 175/218

(Continued)

OTHER PUBLICATIONS

Liu, Wei, et al., "Development and Application of Pressure Control Drilling System (PCDS) for Drilling Complex Problem", International Petroleum Technology Conference IPTC 17143, pp. 1-12, 2013 (12 pages).

(Continued)

*Primary Examiner* — Kenneth L Thompson
(74) *Attorney, Agent, or Firm* — Osha Bergman Watanabe & Burton LLP

(57) ABSTRACT

A downhole tool includes a bore isolation valve, a sensor configured to receive to a downlink signal, an annular pressure sensor, a valve actuation mechanism coupled to the bore isolation valve and responsive to the downlink signal, a pressure relief mechanism configured to provide a negative pressure pulse signal indicative of the annular pressure by venting fluid from a bore of the tool body, and a battery. A method includes drilling a well with a drill bit coupled to an on demand annular pressure tool initially in a deactivated mode, and activating the tool by a downlink signal when fluid flow out of the annulus drops below the fluid flow into the well to close a bore of the tool, pressurizing the drill string, holding pressure in the drill string, measuring annular pressure with the tool, and sending a negative pressure pulse signal indicative of the annular pressure.

8 Claims, 18 Drawing Sheets

(56) References Cited

U.S. PATENT DOCUMENTS

| | | | | |
|---|---|---|---|---|
| 9,534,459 | B2 | 1/2017 | Harms et al. | |
| 9,598,920 | B2 * | 3/2017 | Roders | G05D 7/0617 |
| 10,174,611 | B2 * | 1/2019 | Stolpman | E21B 47/20 |
| 10,184,315 | B2 * | 1/2019 | Harms | E21B 47/06 |
| 10,494,885 | B2 | 12/2019 | Lehr et al. | |
| 10,633,968 | B2 | 4/2020 | MacDonald et al. | |
| 11,073,015 | B2 | 7/2021 | Logan et al. | |
| 11,293,282 | B2 * | 4/2022 | Peter | E21B 47/008 |
| 2008/0029306 | A1 | 2/2008 | Krueger et al. | |
| 2010/0018714 | A1 | 1/2010 | Merlau et al. | |
| 2017/0204690 | A1 * | 7/2017 | Hess | E21B 41/0085 |
| 2020/0104544 | A1 | 4/2020 | Suryadi et al. | |
| 2020/0399974 | A1 | 12/2020 | Papadimitriou et al. | |
| 2021/0040817 | A1 | 2/2021 | Ross et al. | |
| 2021/0140240 | A1 | 5/2021 | Biddick et al. | |

OTHER PUBLICATIONS

International Search Report and Written Opinion of the International Searching Authority issued in corresponding International Application No. PCT/US2022/049004, dated Feb. 17, 2023 (15 pages).

* cited by examiner

ON DEMAND ANNULAR PRESSURE TOOL

BACKGROUND

Conventional drilling of earth includes pumping fluid down a string of connected pipes, called the drill string, and out of a drill bit located at a lower end of the drill string. The fluid or "drilling mud" is then circulated back out of the hole to the surface and the pieces of drilled rock, known as "cuttings," are removed with the drilling mud. The weight of the drilling mud is carefully controlled to provide a pressure on the earth formation that is specifically designed for a given application. In most cases, the weight is designed to be more than the pressure of the formation fluids (e.g., water, hydrocarbons) contained in the drilled rock. The weight of the drilling mud prevents formation fluids from entering the annulus and being transported to surface. If the drilling mud pressure is much greater than the formation pressure, due to, for example, complicated pressure regimes in the subsurface layers or due to the particular type of formation being drilled, the formation may be fractured. This large pressure overbalance and formation fracturing causes drilling fluid to be lost to the formation at very high rates. These "losses" can lead to a drop in the hydrostatic head (i.e., height of the column of mud in the wellbore) which will in turn reduce the pressure in the well. If the pressure is reduced enough, then the formation fluids can start to enter the well with potentially serious consequences.

In lost circulation events (when mud is no longer returned to surface), pumping fluid down through the drill string may be discontinued, as this can increase the pressure at the bottom of the hole by increasing the equivalent circulating density (ECD) and can exacerbate the situation. Conventionally, fluid is pumped directly into the annulus at the surface to keep the well as full as possible to maintain the primary well barrier as required by regulations and for safety.

Measurement-while-drilling (MWD) systems are used to evaluate physical properties downhole such as pressure, temperature, and wellbore trajectory. Many MWD systems use a positive pulse telemetry method and many systems require fluid flow down the drill string to generate power for the MWD systems. Positive pulse telemetry uses positive pressure pulses in the mud system to transmit the MWD system measured data to the surface. When there is no or low fluid flow, the MWD systems are usually turned off, as there is insufficient energy to drive the power turbine to power the MWD systems and/or the pulse signal cannot propagate to the surface.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a downhole tool including a tool body having a bore, a bore isolation valve disposed in the tool body, a sensor configured to receive to a downlink signal, the sensor coupled to the tool body, an annular pressure sensor coupled to the tool body and configured to determine an annular pressure, a valve actuation mechanism coupled to the bore isolation valve, the valve actuation mechanism responsive to the downlink signal, a pressure relief mechanism disposed in the tool body and configured to provide a negative pressure pulse signal indicative of the annular pressure by venting fluid from the bore of the tool body to outside the tool body, the pressure relief mechanism responsive to the downlink signal, and a battery disposed on the tool body for powering the valve actuation mechanism and the pressure relief mechanism.

In another aspect, embodiments disclosed herein relate to a method including drilling a well with a drill bit coupled to an on demand annular pressure tool and a drill string, the drill string coupled to a stand pipe, the on demand annular pressure tool initially in a deactivated mode, monitoring a fluid flow into the well and a fluid flow out of an annulus of the well, measuring annular pressure with an annular pressure sensor coupled to the on demand annular pressure tool, and activating the on demand annular pressure tool by sending a downlink signal from a surface of the well to the on demand annular pressure tool when the fluid flow out of the annulus drops below the fluid flow into the well, wherein the activating the on demand annular pressure tool includes closing a bore of the on demand annular pressure tool, pressurizing the drill string by flowing a fluid into the drill string, holding pressure in the drill string and the stand pipe, and sending a negative pressure pulse signal indicative of the annular pressure to a sensor in the stand pipe at the surface, the sending the negative pressure pulse signal comprising venting a volume of fluid from the bore of the on demand annular pressure tool to the annulus of the well.

In another aspect, embodiments disclosed herein relate to a method including drilling a well in a formation, determining fluid losses into the formation, activating an on demand annular pressure tool coupled to a bottom hole assembly of a drill string and closing a bore of the on demand annular pressure tool to trap fluid in the bore, increasing pressure in the bore to a first predetermined pressure by adding fluid into the drill string, pumping fluid into an annulus of the well to maintain an annular fluid level, determining an annular pressure in the well, venting fluid from the bore of the on demand annular pressure tool to the annulus to create a negative pressure pulse, the negative pressure pulse indicative of the annular pressure, and monitoring pressure in a stand pipe coupled to the drill string at a surface of the well and detecting the negative pressure pulse.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
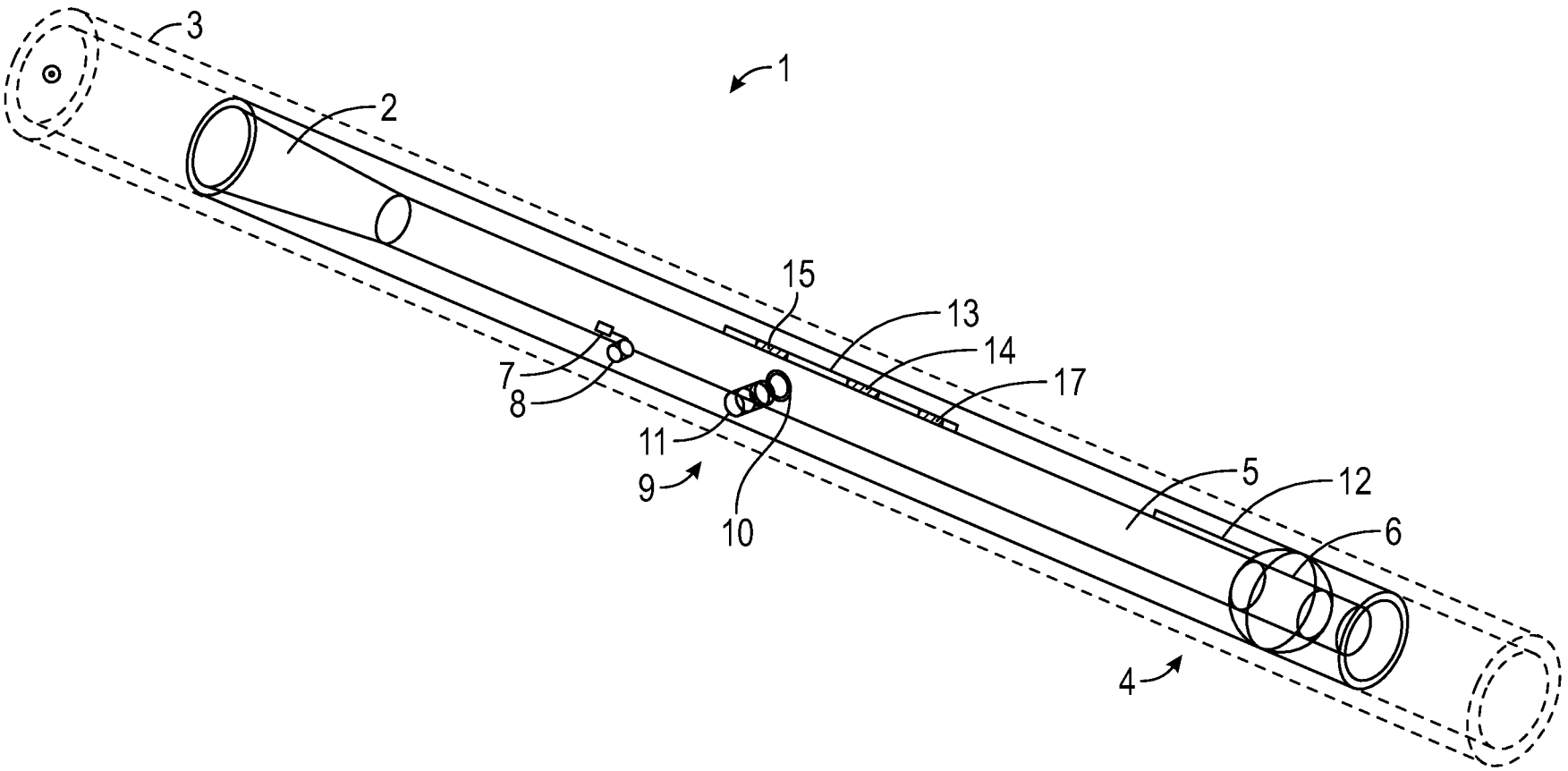
FIG. 1 is a schematic of a downhole tool in accordance with one or more embodiments of the present disclosure.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (for example, first, second, third) may be used as an adjective for an element (that is, any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In one aspect, embodiments disclosed herein relate to tool coupled to a drill string or designed as part of a bottomhole assembly (BHA) that can provide annular pressure and other downhole parameters/conditions. More specifically, embodiments disclosed herein relate to a downhole tool that can transmit annular pressure and other downhole data during fluid loss events. As disclosed herein, a downhole tool in accordance with the present disclosure is self-powered and configured to remain dormant until activated and transmits downhole data to surface during well control or lost circulation events when there is no flow through the drill string.

In another aspect, embodiments disclosed herein relate to an on demand annular pressure tool that provides annular pressure measurement during loss events, including determination of fluid level in the annulus for primary well barrier verification. The on demand annular pressure tool transmits the annular pressure and other information to the surface through a column of fluid during the well control or lost circulation drilling event. In accordance with one or more embodiments, the tool seals off an inner diameter (ID) of the drill string and traps a fluid column above the tool. The tool vents fluid from inside the drill string to an annulus around the drill string to create a negative pressure pulse telemetry signal which can be decoded at the surface. Thus, in accordance with embodiments disclosed herein, a static fluid column is formed which can transmit pressure and other information during well control or loss circulation events. The downhole tool disclosed herein can operate without the need to pump fluid through a drillstring at high flow rates.

Traditionally, during loss events conventional measurement-while-drilling (MWD) tools do not work because there is insufficient mud flow through the tool which is needed to turn the tool on and to detect signals. Lack of MWD data during loss events can present an issue during drilling operations because vital data such as annular pressure cannot be obtained when it is most needed for well control operations. Some telemetry solutions exist such as wired drill pipe and electromagnetic and acoustics which can provide an 'always on' signal but they are not common or have operational limitations.

In accordance with one or more embodiments of the present disclosure, a downhole tool is an on demand tool designed as part of the BHA or drill string and configured to transmit annular pressure and other information to surface through a column of fluid during a well control or lost circulation drilling event without the need to continuously pump mud through the drill string.

FIG. 1 is a simple schematic of a downhole tool 1 in accordance with one or more embodiments of the present disclosure. The downhole tool 1 includes a tool body 2 and a sleeve housing 3. The sleeve housing 3 may be coupled to a drill string (not shown), by threaded engagement at a first end and a second end of the sleeve housing 3. As such, the downhole tool 1 may be assembled into the drill string, and in one or more embodiments, may be a part of the BHA located above a drill bit (not shown). As shown, the tool body 2 is disposed within tubular sleeve housing 3. The tool body is generally a hollow cylinder tubular with a bore 5. The bore 5 of the tool body 2 is generally configured to allow for unrestricted flow therethrough during normal operations (prior to activation of the downhole tool).

The downhole tool 1 also includes a bore isolation valve 4 located in a lower end of the tool body 2. The bore isolation valve 4 is a valve configured to close or seal off the bore 5 of the tool body 2, thereby restricting or preventing fluid flow through the downhole tool 1, and therefore also restricting or preventing fluid flow through the drill string (not shown). In one or more embodiments, the bore isolation valve 4 may be a ball valve 6 rotatable between an open flow position and a closed flow position. In the open flow position, a diameter of a bore of the ball valve 6 may be approximately equal to the bore 5 of the tool body 2 to allow for unrestricted flow through the tool body 2.

The ball valve 6 is electrically actuated by a valve actuation mechanism 12. The valve actuation mechanism 12 may be, for example, a solenoid, an electrically actuated sliding sleeve, or a worm gear coupled to a motor. Activation of the valve actuation mechanism 12 causes the ball valve 6 to rotate from the open flow position to the closed flow position and from the closed flow position to the open flow position. The ball valve 6 may be actuated repeatedly allowing for cycling between open and closed fluid flow through the downhole tool 2. The valve actuation mechanism 12 may be responsive to a downlink signal, such that the valve actuation mechanism 12 activates in response to a downlink signal.

The downhole tool 1 also includes an annular pressure sensor 7 coupled to the tool body 2 and configured to measure an annular pressure of an annulus surrounding the downhole tool 1. The annular pressure sensor 7 is fluidly coupled to a pressure channel 8 in the sleeve housing 3 to allow for the annular pressure sensor 7 to measure the annular pressure. In one or more embodiments, the annular pressure sensor 7 may be located inside the tool body 2 and a tool body annular pressure channel (not shown) may be fluidly coupled to the annular pressure channel 8 in the sleeve housing 3 to allow for fluid communication between the annulus and the annular pressure sensor 7.

The downhole tool 1 includes a pressure relief mechanism 9 to vent fluid from inside the downhole tool 1 to the annulus to create negative pressure pulse signals from the downhole tool 1 sent to the surface. The negative pressure pulse signal may be indicative of an annular pressure measured or determined by the annular pressure sensor 7. The pressure relief mechanism 9 may be responsive to a downlink signal, such that the pressure relief mechanism 9 activates in response to a downlink signal. The pressure relief mechanism 9 includes a diverter valve 10 coupled to the tool body 2. In one embodiment, the diverter valve 10 may be disposed in a relief channel (not shown) extending through a wall of the tool body from an inner diameter of the tool body 2 to an outer diameter of the tool body 2. The sleeve housing 3 has one or more ports 11 in fluid communication with the relief channel of the tool body 2. The diverter valve 10 is configured to open and close to allow or prevent, respectively, fluid flow from the bore 5 of the tool body 202 to the annulus.

The diverter valve 10 may be any valve known in the art to open or close a channel or port to vent fluid from inside the downhole tool 1 to outside the tool 1 to the annulus. For example, diverter valve 10 may include a solenoid actuated valve, a ball valve, orifice plates, or sliding sleeves. In one or more embodiments, diverter valve 10 includes a solenoid with an associated sliding rod to open and close the relief channel, as discussed in more detail below with respect to FIGS. 10-12.

The downhole tool 1 also includes an electronics package 13 disposed on the tool body 2. The electronics package 13 may include additional sensors, a power source, and electronics for a telemetry system including, for example, a processor and associated circuitry, which acts following programmed instructions, transducers, and receivers. The electronics package 13 may include standard MWD and logging-while-drilling (LWD) electronics known to those skilled in the art. The electronics used are generally designed to withstand high temperature environments (approximately 120° C.-175° C.), shock, and vibration. The power source may include one or more batteries 17. Batteries 17 may be lithium-thionyl chloride batteries to provide the required run time and to withstand high temperatures.

The electronics package 13 may also include one or more sensors. The one or more sensors may is configured to receive a downlink signal from the surface or may be configured to determine or measure downhole parameters. The electronics package 13 may include the annular pressure sensor 7. The downhole tool 1 may include one or more magnetometers or gyro sensors coupled to a circuit board in the electronics package 13 to sense or determine a rotational speed of the drill string. The downhole tool 1 may also include a temperature sensor coupled to a circuit board in the electronics package 13 to determine a temperature. The downhole tool 1 may also include an accelerometer coupled to a circuit board in the electronics package 13 to sense a shock perceived by the downhole tool 1. The electronics package 13 may also include equipment to determine and record status parameters such as battery voltage, operating current, tool cycles, and operating time. Further, the electronics package 13 may include a programmable logic controller (PLC) 14 to drive an operating sequence of the downhole tool, including activating the downhole tool 1 and operating the valve actuation mechanism 12 and the pressure relief mechanism 9. The PLC 14 may include memory storing input data and control programs, an input and output interface, a communications interface to receive and transmit data on communication networks from/to remote PLCs (e.g., in valve actuation mechanism 12, pressure relief mechanism 9, or valves), a power supply, and a processor, which may interpret inputs, execute the control programs, and send output signals.

The electronics package 13 is configured such that the downhole tool 1 is self-powered. The electronics package 13 is electrically coupled to the valve actuation mechanism 12 and the pressure relief mechanism 9. During normal operations, the downhole tool 1 is dormant until activated. The downhole tool 1 is activated via downlinking from the surface. Specifically, the downhole tool 1 turns on when the downhole tool 1 receives a downlink signal to turn on. Sensors 15 in the downhole tool 1 are configured to receive and respond to surface commands (the downlink signal). The surface commands may be sent through variations in fluid flow rate, e.g., by manipulating surface pumps, manipulations of the drill string rotational speed (e.g., increase or decrease of rotations per minute (RPM)), RFID tags, or combinations of these. The instruction of the downlink may be coded by the time of high flow rate levels and low flow rate levels or by specific tool on/off sequences.

Figure 2:
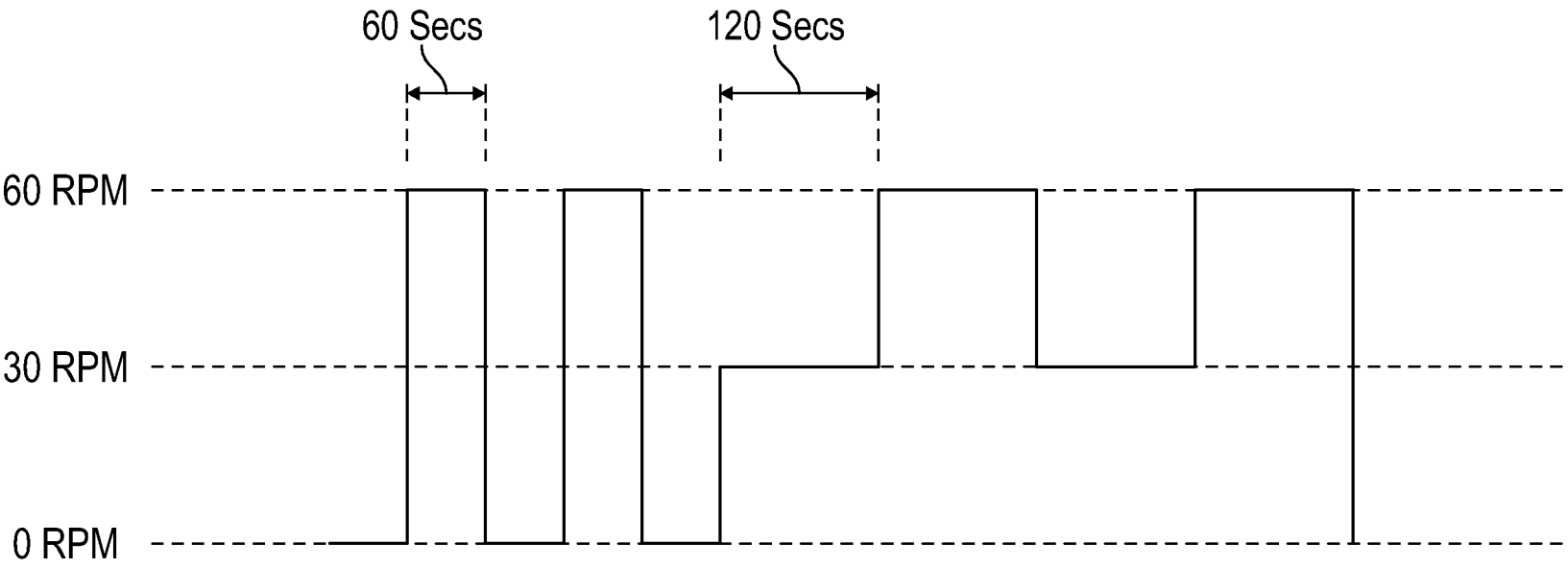
FIG. 2 shows a rotational speed pattern of a drill string for a downlink signal for a downhole tool in accordance with one or more embodiments of the present disclosure.

The downhole tool 1 may detect these signals by using a sensor that measures, for example, direct internal bore pressure. In other embodiments, the downhole tool 1 may detect the downlink signals at a programmed shaft rotational speed (RPM) if there is a turbine or similar device in the downhole tool 1. In other embodiments, a magnetometer or gyro sensor in the downhole tool 1 may sense variations in the drill string rotational speed. In still other embodiments, the downhole tool 1 may have one or more RFID readers configured to sense and read information on an RFID tag that is dropped from the surface and pumped past the downhole tool 1 with specific codes embedded in each tag. A combination of one or more of these downlink methods may be used. For example, the downhole tool 1 may include magnetometers or a gyro sensor in the tool 1 to detect rotational speed and a bore pressure sensor to detect changes in the internal bore pressure. The surface rotational speed of the drill string is varied with a specific pattern of rotational speed and time spent at each speed, as shown in FIG. 2. The sensors in the downhole tool 1 are then set to activate the downhole tool 1 when the specific pattern is detected. Activating the downhole tool 1 may include activating the valve actuation mechanism 12 to close the bore and activating the pressure relief mechanism 9. Activating the downhole tool 1 may also include activating the tool to take annular pressure measurements with the annular pressure sensor 7 and transmitting the annular pressure to the surface via the pressure relief mechanism 9. To differentiate a downlink from normal drilling activities, the drill string rotational speed patterns are different and may include, for example, a number of high speed pulses, different upper and lower limit thresholds, or varied timing. The bore pressure may be used as a safety lock to prevent accidental activation of the downhole tool 1, such that activation may occur only at a programmed bore pressure. Thus, a pump flow rate may be varied at the surface to change the bore pressure in the downhole tool 1. Alternatively, surface pumps may be varied between low flow, high flow, and mid flow at specific intervals or patterns to provide a downlink signal to the downhole tool 1 to activate.

In accordance with one or more embodiments, once the downhole tool 1 detects the downlink signal to turn on the downhole too 1, the PLC 14 may control the sequence of operations such that a signal is sent to the valve actuation mechanism 12 to close the ball valve 6. Upon confirmation that the ball vale 6 has closed, the downhole tool 1 may then activate the pressure relief mechanism 9 to provide a pulsing sequence of negative pressure pulse signals to the surface to indicate the annular pressure measured or determined by the annular pressure sensor 7. If the ball valve 6 does not properly operate, such that the ball valve 6 does not close or does not fully close, a signal will not be sent to the PLC 14 and the PLC 14 will not activate the pressure relief mechanism 9 as a fail safe.

The downhole tool 1 may take measurements, such as annular pressure, temperature, bore pressure, etc. using one or more sensors coupled to the tool body 2 or within the electronics package 13 and send a signal back to the surface indicative of the measurement. The electronics package 13 may be configured to receive data from one or more sensors and convert the data to a signal to activate the valve actuation mechanism, the pressure relief mechanism, or to transmit a signal to the surface of the well indicative of a measured or determined downhole parameter. In one or more embodiments, annular pressure is measured and transmitted to the surface in realtime. A sensor or transducer may be located on the rig standpipe (not shown) to detect the signal returned by the downhole tool 1. The signal returned by the tool 1, in accordance with one or more embodiments, is a negative pressure mud pulse signal.

Figure 3A:
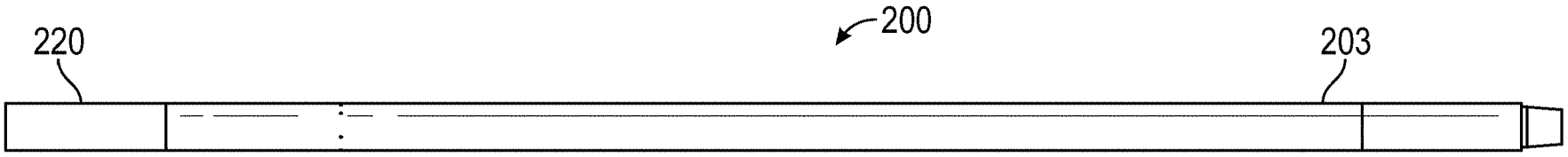
FIG. 3A is a front view of a downhole tool in accordance with one or more embodiments of the present disclosure.
Figure 3B:
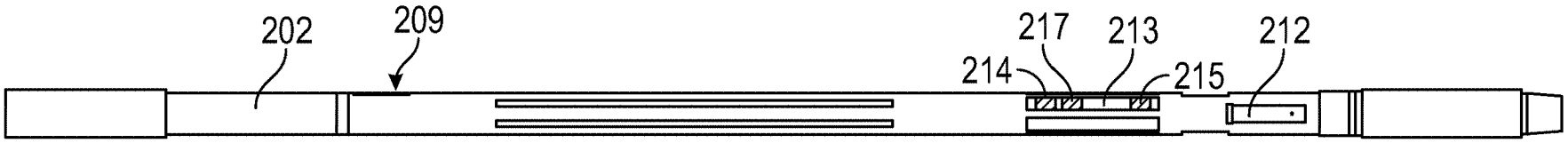
FIG. 3B is a front view of the downhole tool of FIG. 3A with a sleeve housing removed in accordance with one or more embodiments of the present disclosure.
Figure 3C:
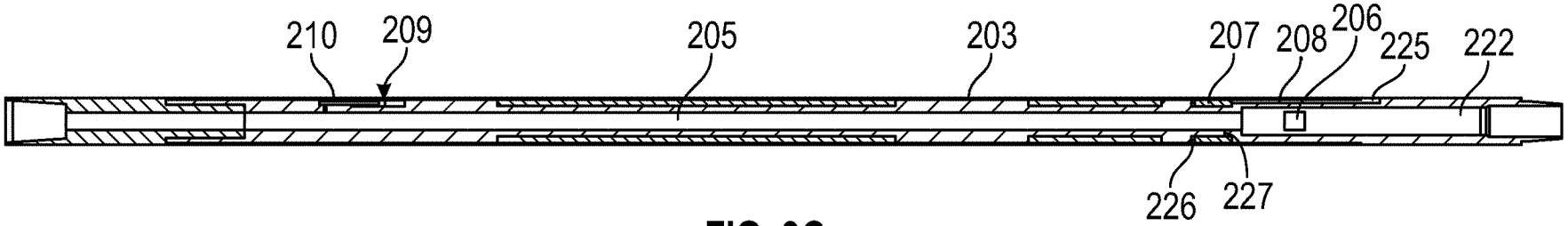
FIG. 3C is a cross-sectional view of the downhole tool of FIG. 3A in accordance with one or more embodiments of the present disclosure.
Figure 4A:
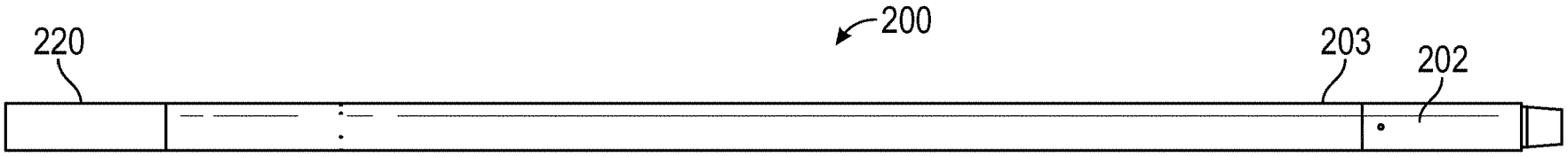
FIG. 4A is a top view of the downhole tool of FIG. 3A in accordance with one or more embodiments of the present disclosure.
Figure 4B:
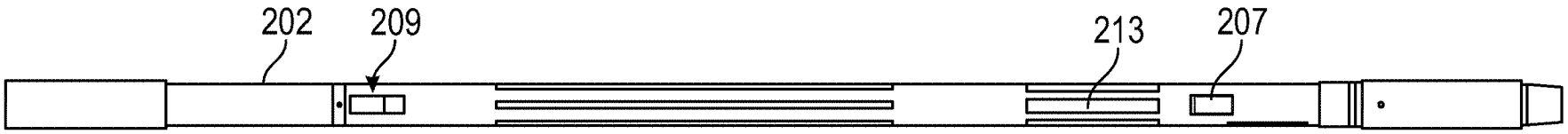
FIG. 4B is a top view of the downhole tool shown in FIGS. 3A and 4A with the sleeve housing removed in accordance with one or more embodiments of the present disclosure.
Figure 4C:
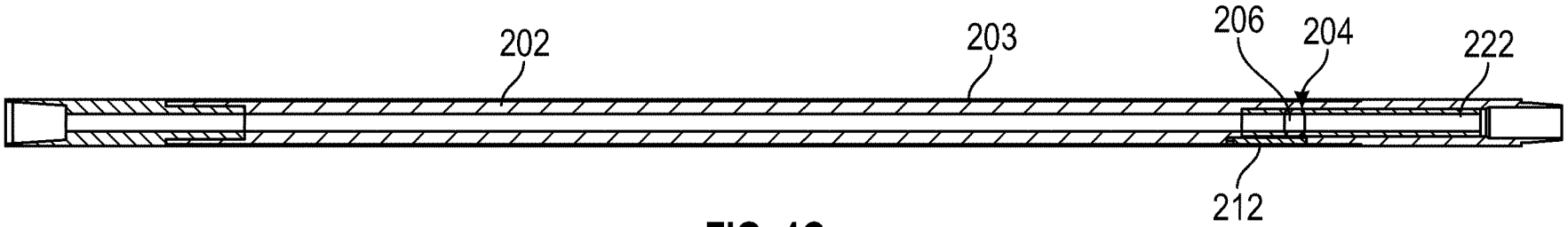
FIG. 4C is a cross-sectional view of the downhole tool shown in FIG. 4A in accordance with one or more embodiments of the present disclosure.
Figure 5A:
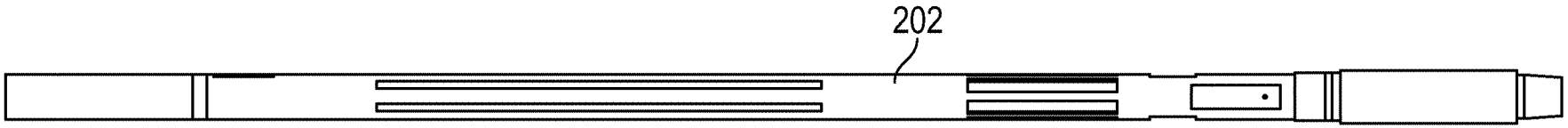
FIG. 5A is a front view of a tool body of the downhole tool of FIG. 3A in accordance with one or more embodiments of the present disclosure.
Figure 5B:
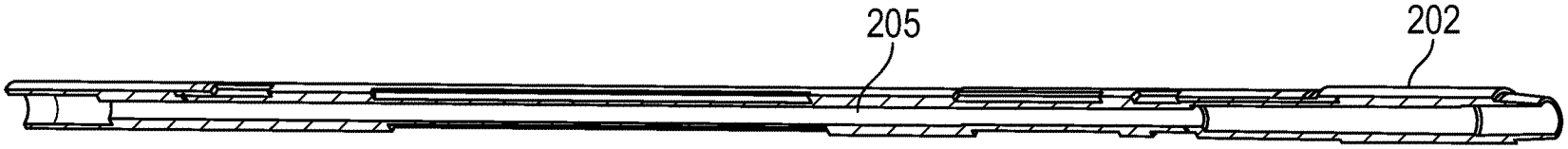
FIG. 5B is a cross-sectional view of the tool body of FIG. 5A in accordance with one or more embodiments of the present disclosure.

FIGS. 3A-3C and 4A-4C show a downhole tool 200 in accordance with one or more embodiments. Downhole tool 200 is configured to provide on demand annular pressure measurements downhole during well control or lost circulation events. FIG. 3A shows a front view of the downhole tool 200 and FIG. 3B shows a front view of the downhole tool 200 with an outer sleeve housing 203 removed. FIG. 3C shows a cross-sectional view of the downhole tool 200 of FIG. 3A. FIG. 4A shows a top view, FIG. 4B shows a top view, and FIG. 4C shows a cross sectional view of the downhole tool of FIGS. 3A-3C. As shown, downhole tool 200 includes a tool body 202, sleeve housing 203 enclosing the tool body 202, and an upper sub 220 coupled to an upper end of the tool body 202. The tool body 202 is generally a hollow cylinder with a bore 205 extending from the upper end to the lower end, as shown in FIGS. 5A-5B. The bore 205 of the tool body 202 is generally configured to allow for unrestricted flow therethrough during normal operations (prior to activation of the downhole tool 200).

Figure 6A:
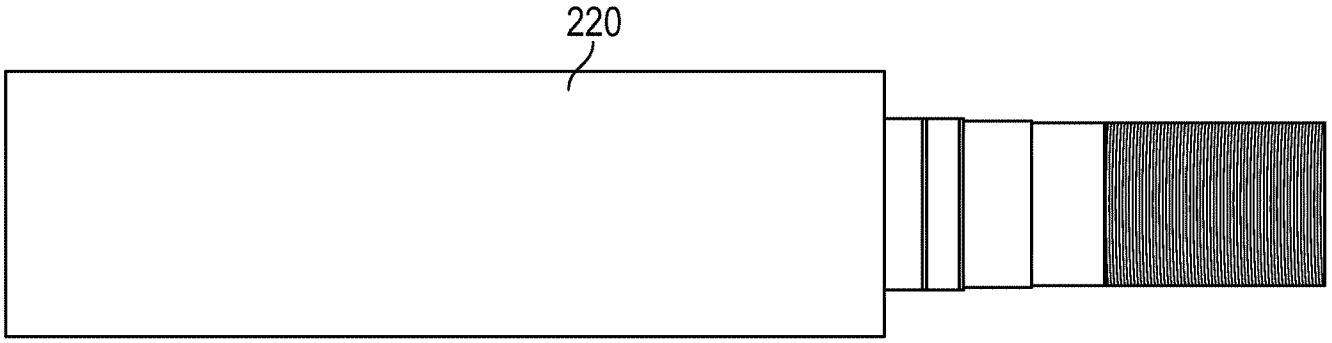
FIG. 6A is a front view of a top sub of the downhole tool of FIG. 3A in accordance with one or more embodiments of the present disclosure.
Figure 6B:
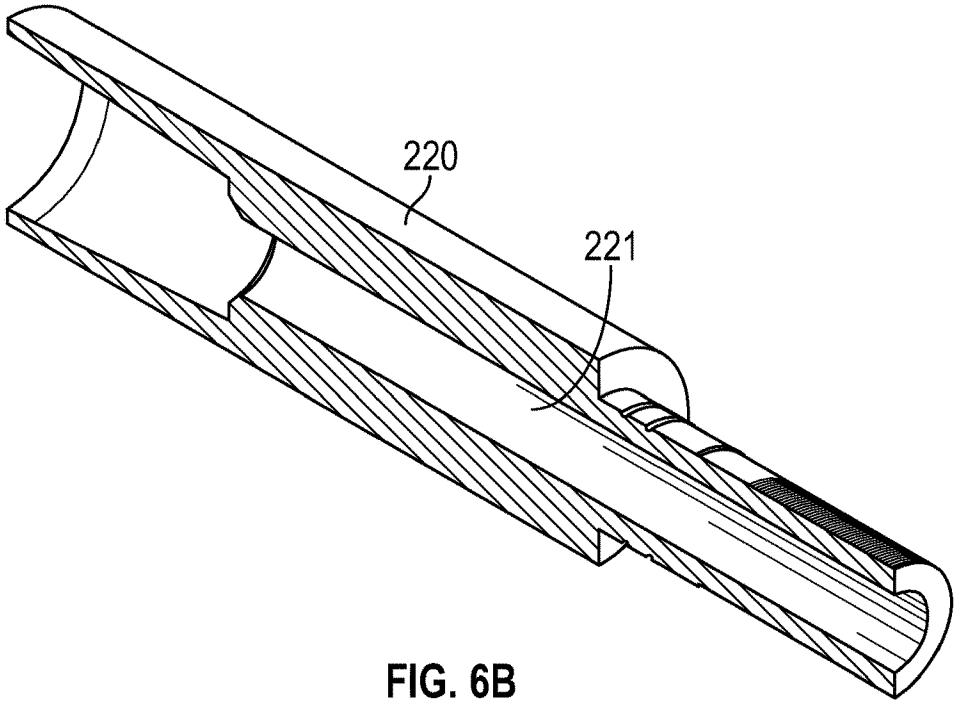
FIG. 6B is a cross sectional view of the top sub of FIG. 6A in accordance with one or more embodiments of the present disclosure.

A lower end of the tool body 202 is configured to couple to a drill string (not shown) and the upper sub 220 is configured to couple an upper end of the tool body 202 to a drill string (not shown). Upper sub 220 may be threaded engaged with the upper end of the tool body 202 and has a bore 221 that aligns with bore 205 of the downhole tool 200, as shown in FIGS. 3C, 6A, and 6B.

Figure 7A:
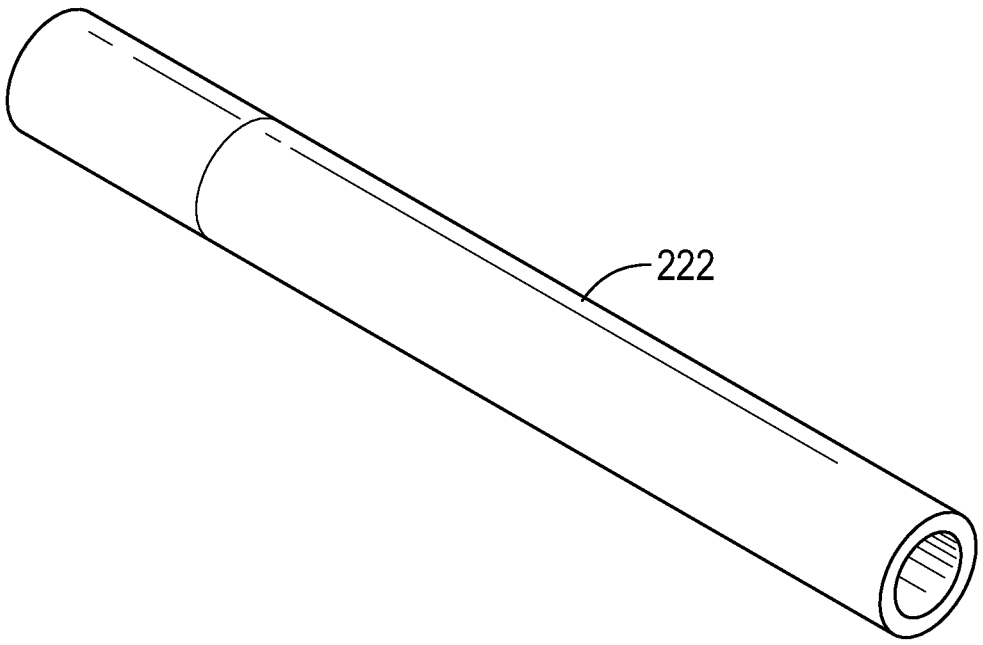
FIG. 7A is a perspective view of a ball valve housing of the downhole tool of FIG. 3A in accordance with one or more embodiments of the present disclosure.
Figure 7B:
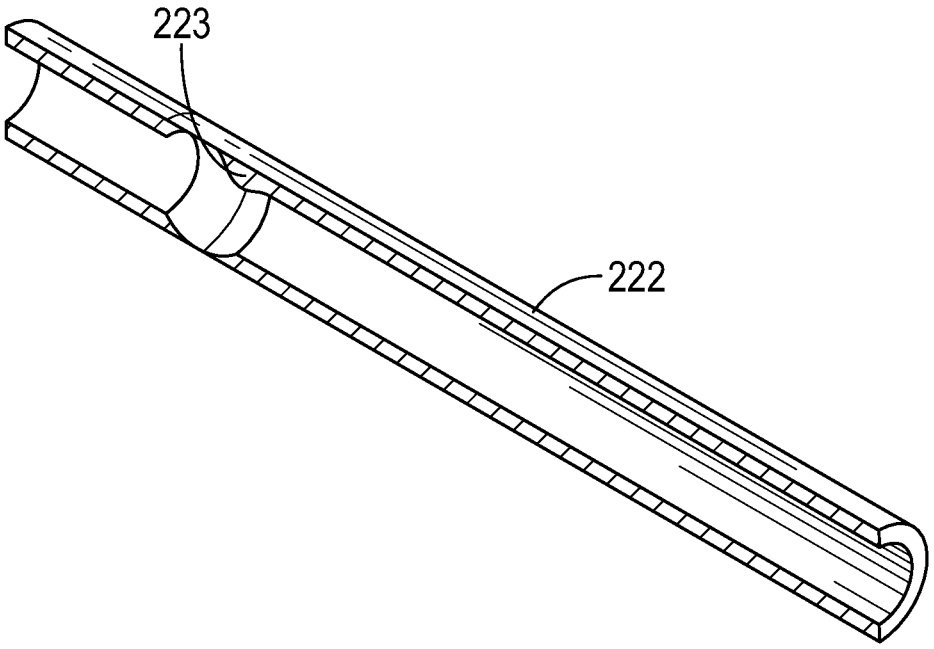
FIG. 7B is a cross sectional view of the ball valve housing of FIG. 7A in accordance with one or more embodiments of the present disclosure.
Figure 8C:
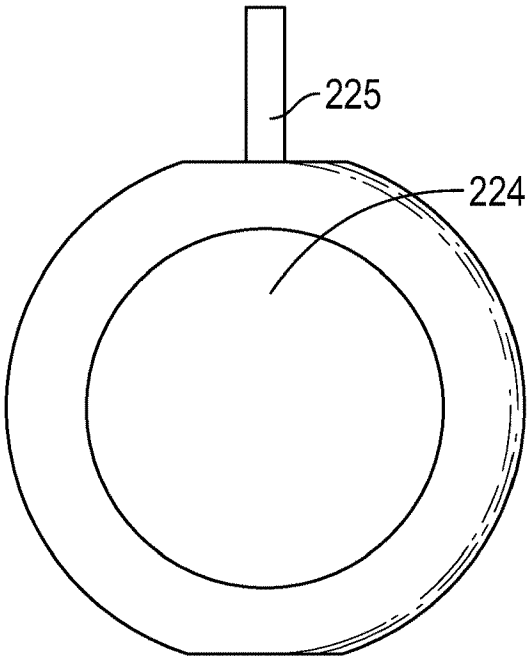
FIGS. 8A-8C show a perspective view, top view, and side view, respectively, of a ball valve of the ball valve housing of FIGS. 7A-7B in accordance with one or more embodiments of the present disclosure.
Figure 8B:
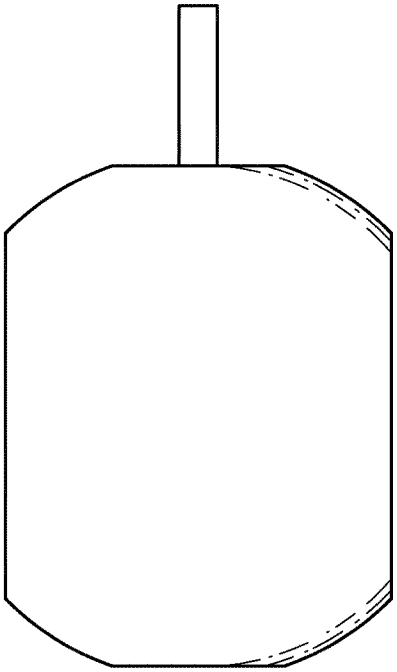
Figure 8A:
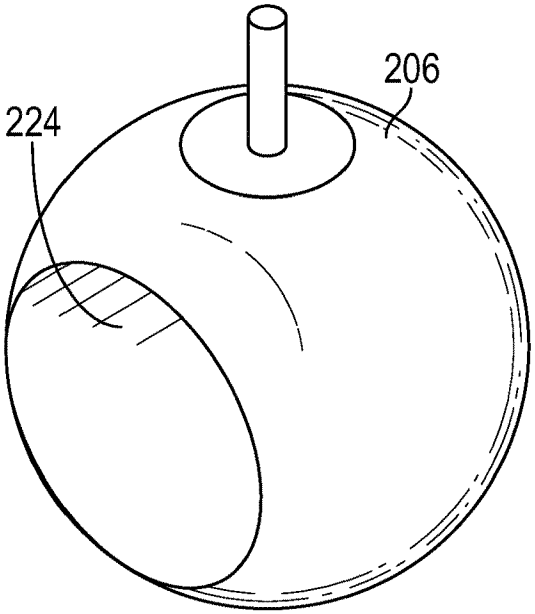
Figure 9B:
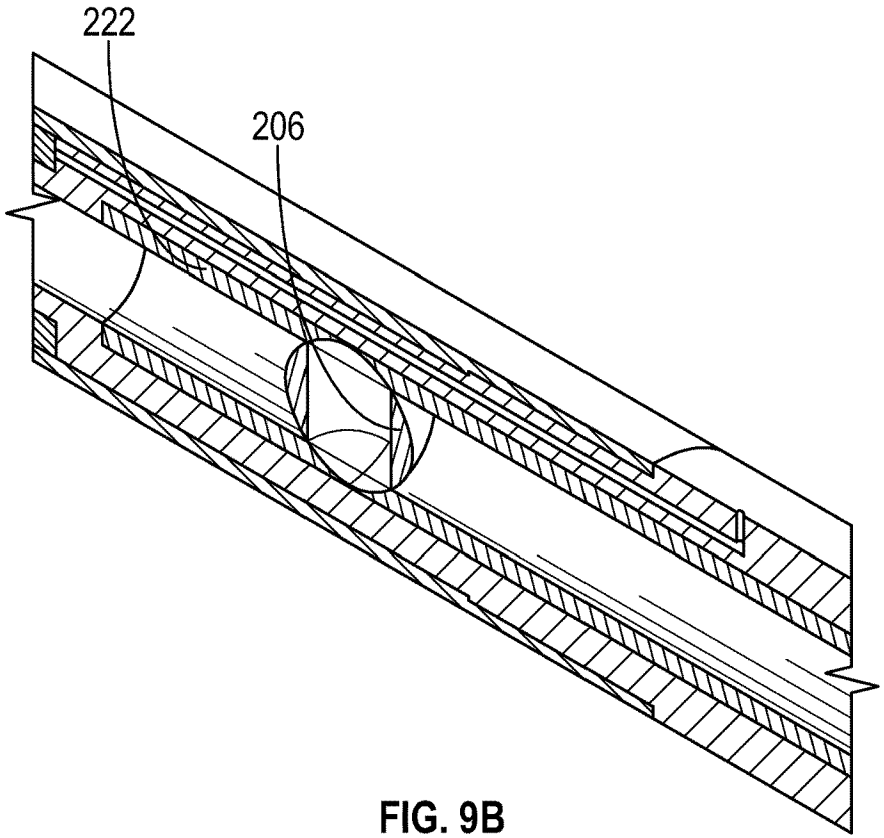
FIG. 9B shows a partial view of the downhole tool of FIG. 3A, in cross section, with the ball valve in a closed position in a closed position in accordance with embodiments of the present disclosure.
Figure 9A:
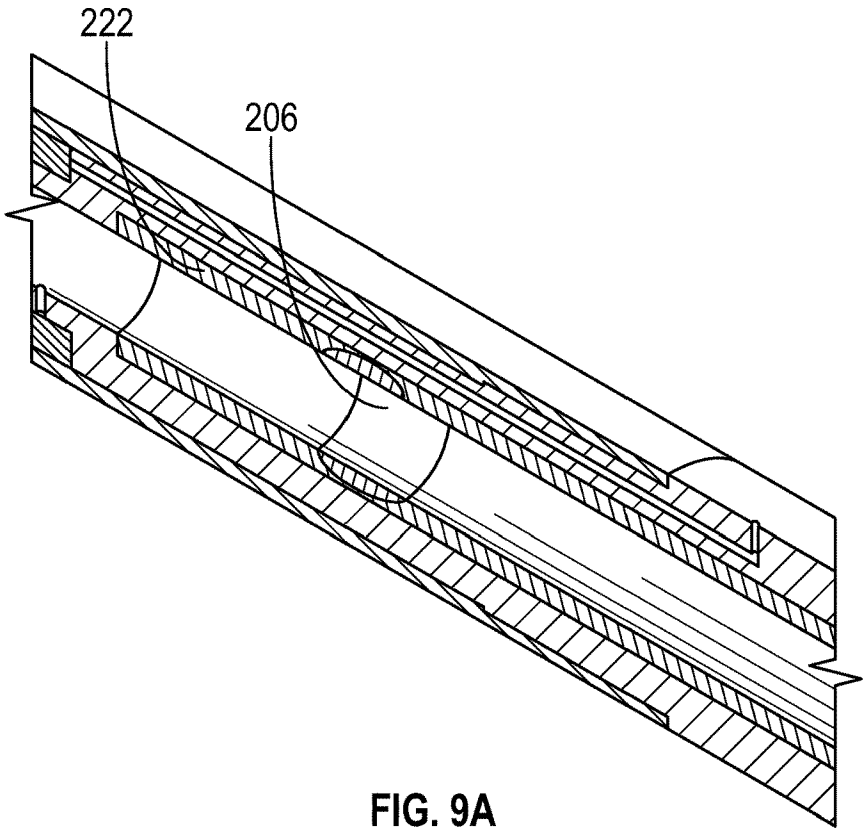
FIG. 9A shows a partial view of the downhole tool of FIG. 3A, in cross section, with the ball valve in an open position in a closed position in accordance with embodiments of the present disclosure.

Still referring to FIGS. 3A-3C and 4A-4C, the downhole tool 200 also includes a bore isolation valve 204 located in the lower end of the tool body 202. The bore isolation valve 204 is a valve configured to close or seal off the bore 205 of the tool body 202, thereby restricting or preventing fluid flow through the downhole tool 200, and therefore also restricting or preventing fluid flow through the drill string (not shown). In one or more embodiments, the bore isolation valve 204 may be a ball valve 206. The ball valve 206 is positioned within a ball valve housing 222, the ball valve housing 222 being positioned within the lower end of the tool body 202. The ball valve housing 222 is generally a hollow cylinder with a recess 223 having a profile corresponding to a profile of the ball valve formed on an inside surface of ball valve housing 222, as shown in FIGS. 7A and 7B. As shown in FIGS. 8A-8C, the ball valve 206 has a generally spherical outer shape with a cylindrically shaped bore 224. The ball valve 206 has a pin coupled to an outer surface of the ball valve, the pin configured to engage with a corresponding opening formed in an inner surface of the ball valve housing 222, shown in FIG. 4A. The ball valve 206 is rotatable between an open flow position (FIG. 9A) and a closed flow position (FIG. 9B). In the open flow position, a diameter of a bore of the ball valve 206 may be approximately equal to the bore 205 of the tool body 202 to allow for unrestricted flow through the tool body 202.

In one or more embodiments, the ball valve 206 is electrically actuated by a valve actuation mechanism 212. The valve actuation mechanism 212 may be, for example, a solenoid, an electrically actuated sliding sleeve, or a worm gear coupled to a motor. Activation of the valve actuation mechanism 212 causes the ball valve 206 to rotate from the open flow position to the closed flow position and from the closed flow position to the open flow position. The ball valve 206 may be actuated repeatedly allowing for cycling between open and closed fluid flow through the downhole tool 200. The valve actuation mechanism 212 may be responsive to a downlink signal, such that the valve actuation mechanism 212 activates in response to a downlink signal.

The downhole tool 200 also includes an annular pressure sensor 207 coupled to the tool body 202 and configured to measure an annular pressure of an annulus surrounding the downhole tool 200. The annular pressure sensor 207 may be disposed on an outer surface of the tool body 202. As shown in FIG. 3C, the annular pressure sensor 207 is fluidly coupled to a pressure channel 208 in the tool body 202 connected to a pressure port 225 extending through an outer surface of the tool body 202 to allow for fluid communication between the annulus and the annular pressure sensor 207 so that the annular pressure sensor 207 can measure the annular pressure.

The downhole tool 200 may also include a bore pressure sensor 226 coupled to the tool body 202 and configured to measure a bore pressure of the bore 205. The bore pressure sensor 226 may be disposed in the tool body 202 or on an outer surface of the tool body 202. As shown in FIG. 3C, the bore pressure sensor 226 is fluidly coupled to a pressure port 227 extending through an inner surface of the tool body 202 to allow for fluid communication between the bore 205 of the tool body 202 and the bore pressure sensor 226 so that the bore pressure sensor 226 can measure the bore pressure.

Referring again to FIGS. 3A-3C and 4A-4C, the downhole tool 200 includes a pressure relief mechanism 209 to vent fluid from inside the downhole tool 200 to outside the downhole tool 200 (to the annulus) to create negative pressure pulse signals from the downhole tool 200 to the surface. The negative pressure pulse signal may be indicative of an annular pressure measured or determined by the annular pressure sensor 7. The pressure relief mechanism 209 may be responsive to a downlink signal, such that the pressure relief mechanism 209 activates in response to a downlink signal. In accordance with embodiments herein, the pressure relief mechanism 209 may be responsive to a signal from the electronics package 213 in response to the downlink signal. In other words, the electronics package 213 of the downhole tool 200 receives a downlink signal that activates the tool and starts a sequence of operations of the downhole tool 200 including activation of the pressure relief mechanism 209.

The pressure relief mechanism 209 includes a diverter valve 210 coupled to the tool body 202. FIGS. 10A-12B show the diverter valve 210 disposed in a relief channel 228 formed in the tool body 202. The relief channel 228 is in fluid communication with a bore port, as shown here, relief port 229, extending from the bore 205 of the tool body 202 radially inward to the bore 205. The relief channel 228 is in fluid communication with an annulus port, as shown here, annulus relief port 230 formed in the tool body 202 extending from an outer surface of the tool body 202 radially inward to the relief channel 228. The sleeve housing 203 has one or more ports 211 in fluid communication with the annulus relief port 230 and the relief channel 228 of the tool body 202 to allow fluid communication with the annulus. The diverter valve 210 is configured to open and close to allow or prevent, respectively, fluid flow from the bore 205 of the tool body 202 to the annulus.

The diverter valve 210 may be any valve known in the art to open or close a channel or port to vent fluid from inside the downhole tool 200 to outside the downhole tool 200 to the annulus. For example, diverter valve 210 may include a solenoid actuated valve, a ball valve, orifice plates, or a sliding sleeve. In one or more embodiments, as shown in FIGS. 10A-12B, the diverter valve 210 includes a solenoid 231 with an associated sliding rod 232 to open and close fluid access through the relief channel 228.

Figure 10A:
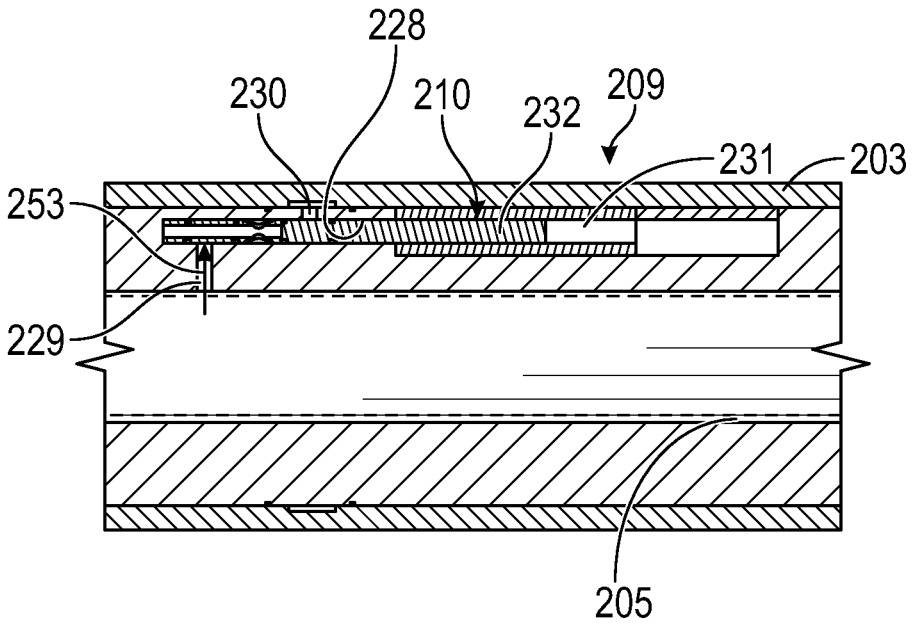
FIGS. 10A and 10B show a pressure relief mechanism of the downhole tool of FIG. 3A, in cross section, in a closed position in accordance with embodiments of the present disclosure.
Figure 10B:
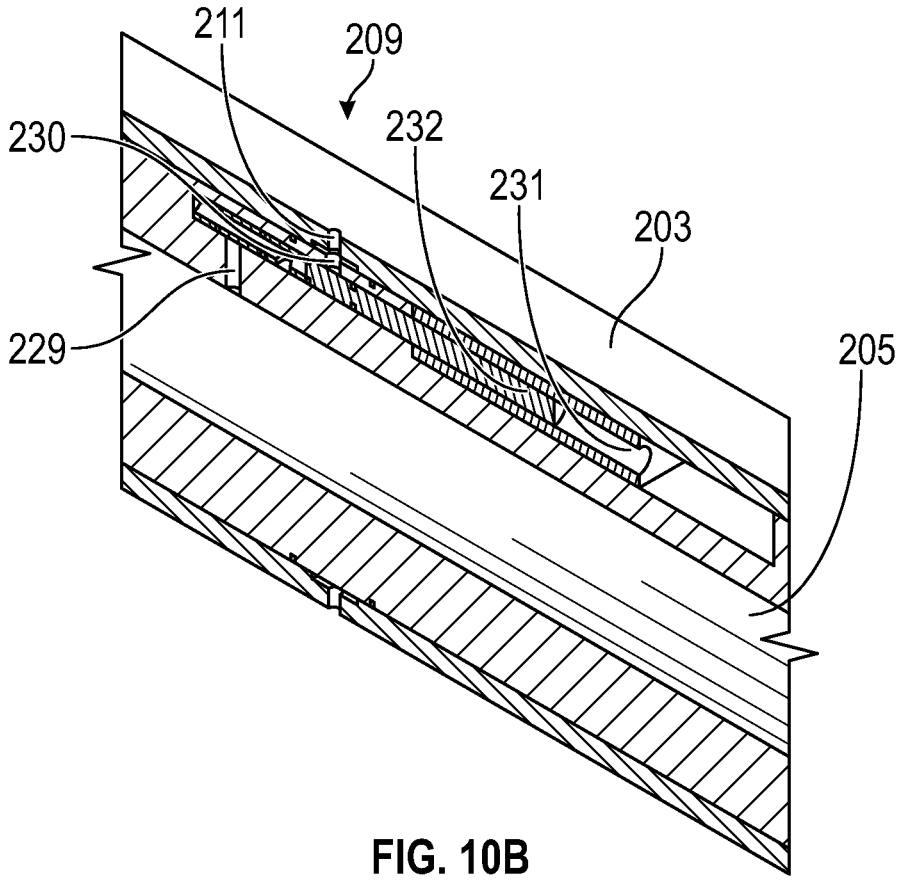

FIGS. 10A and 10B show the diverter valve 210 in a closed position thereby preventing fluid from flowing through and out the relief channel 228 and annulus relief port 230. During normal drilling operations, the diverter valve 210 of the pressure relief mechanism 209 is in the closed position. In the closed position, the sliding rod 232 is in an extended position from the solenoid 231. A spring or coil may be disposed in the solenoid 231 to maintain the sliding rod 232 in the extended position. As shown in FIG. 10A, fluid flow from the bore 205 (indicated by arrow 253) is prevented from flowing through the relief channel 228 and relief port 229 by the sliding rod 232 extended from the solenoid 231 past the relief port 229, closing the relief port 229.

As described in more detail below, during certain drilling situations, such as well control or lost circulation events, the downhole tool 200 closes the bore 205 of the tool body 202 below the pressure relief mechanism 209. To send a negative pressure pulse signal to the surface through the drill string, fluid from within the bore 205 is vented through the pressure relief mechanism 209 by opening the diverter valve 210. The diverter valve 210 is actuated by the electronics package 213 in response to a downlink signal from the surface. Upon actuation, the solenoid 231 of the diverter valve 210 is electrically energized and creates a magnetic field that pulls the sliding rod 232 into the solenoid, thereby opening the relief port 229 and providing fluid communication through the relief port 229, the relief channel 228, annulus relief port 230, and the port 211 in the sleeve housing 203. Although solenoid actuation of the sliding rod 232 is disclosed herein, a person of ordinary skill in the art will appreciate that other actuation mechanisms that move the sliding rod 232 to open and close access to the relief channel 228 and relief port 229 may be used without departing from the scope of embodiments disclosed herein.

Figure 11A:
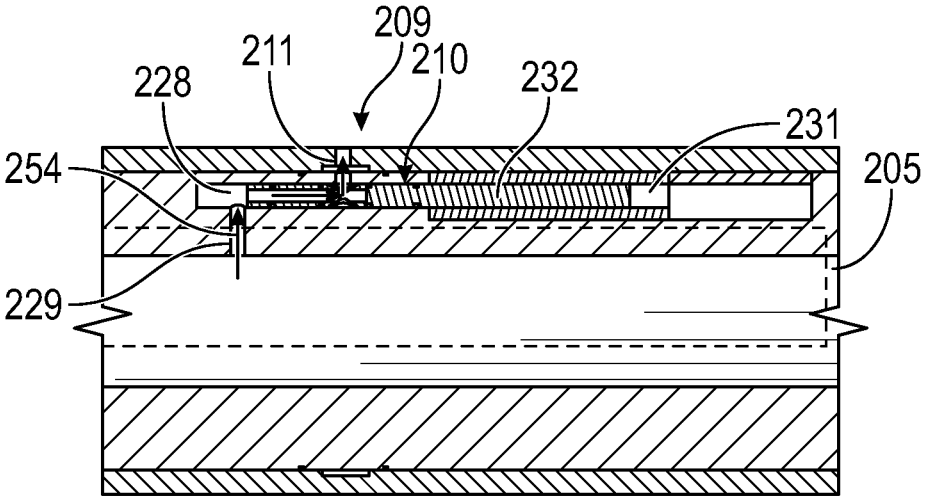
FIGS. 11A and 11B show the pressure relief mechanism of the downhole tool of FIG. 3A, in cross section, in an open position in accordance with embodiments of the present disclosure.
Figure 11B:
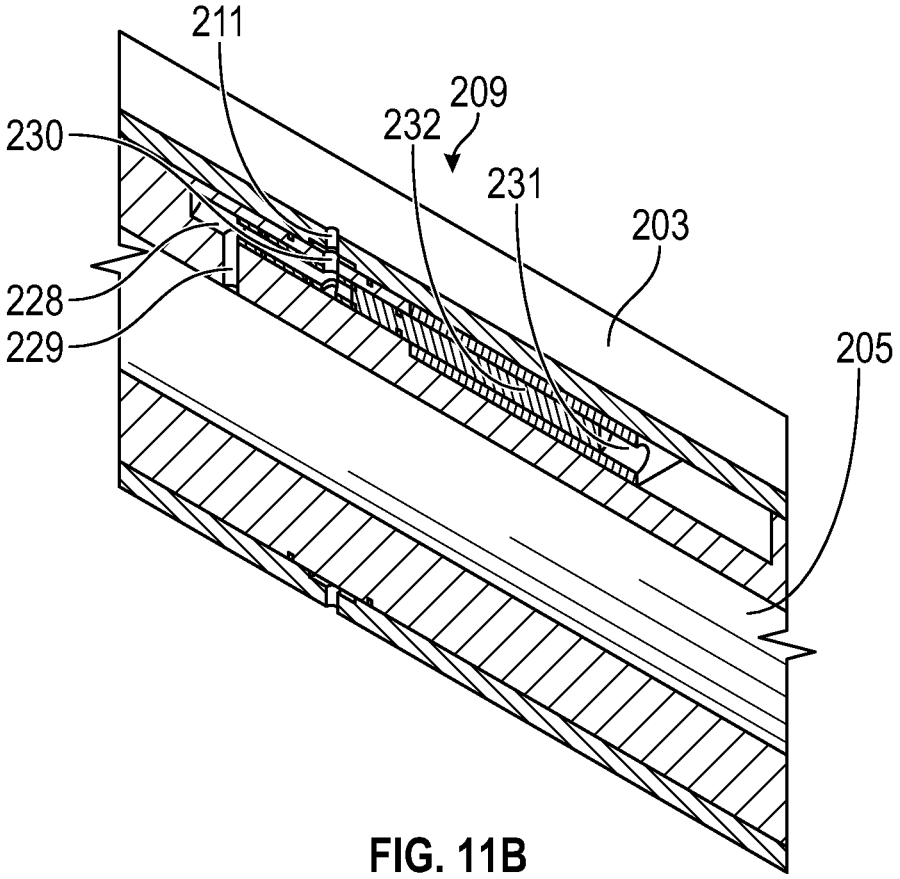

FIGS. 11A and 11B show the diverter valve 210 in an open position which allows fluid from the bore 205 to flow through and out the relief port 229, the relief channel 228, the annulus relief port 230, and through the port 211 in the sleeve housing 203. Venting of fluid from the bore 205 through the pressure relief mechanism 209 and out of the downhole tool 200 (FIG. 3C) sends a negative pressure pulse signal up a column of fluid in the bore of the drill string (not shown) to the surface.

Figure 12A:
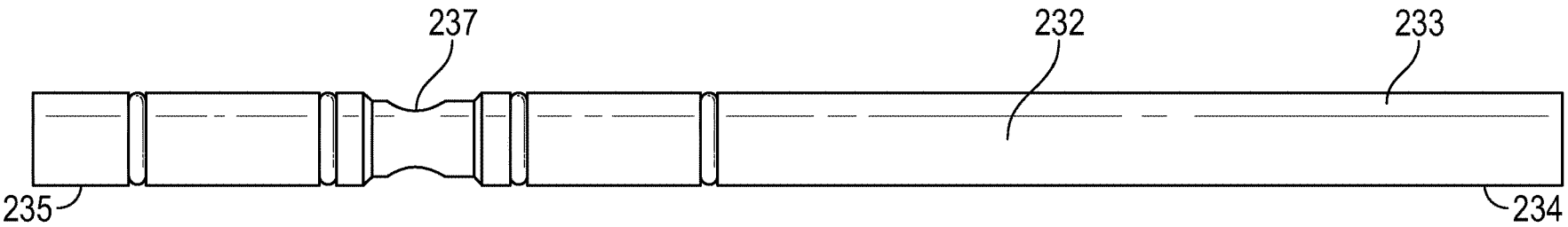
FIGS. 12A and 12B show a front view and a cross sectional view, respectively, of a solenoid rod of the pressure relief mechanism of FIGS. 11A and 11B in accordance with embodiments of the present disclosure.
Figure 12B:
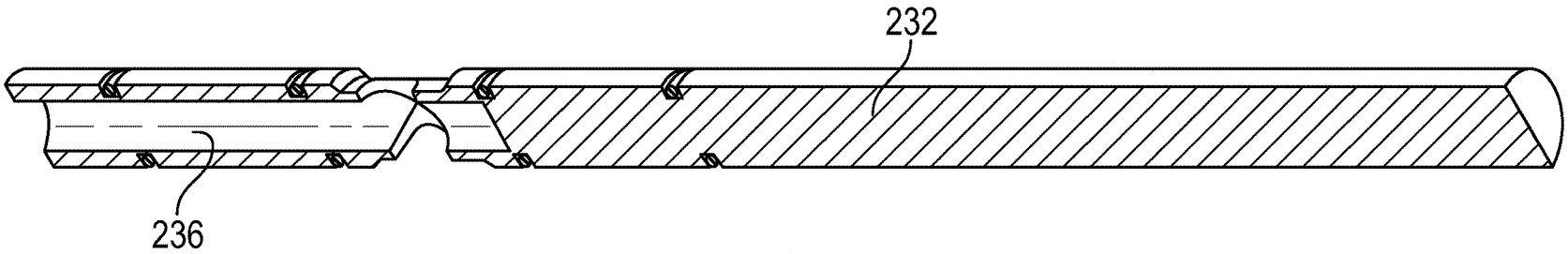

FIGS. 12A and 12B shown an example of a sliding rod 232 for the diverter valve 210 (FIG. 11A) in accordance with one or more embodiments disclosed herein. As shown, sliding rod 232 may have a cylindrical body 233 with a first end 234 configured to slidingly engage with a bore of the solenoid 231 (FIG. 11A). A second end 235 of the cylindrical body 233 is a hollow cylinder having a bore 236. The sliding rod 232 also includes one or more ports 237 located between the first end 234 and the second end 235 and providing fluid access from the bore 236 to outside the sliding rod 232.

Referring to FIGS. 10A-12B together, when the sliding rod is extended from the solenoid 231 in the closed position, the second end 235 of the sliding rod 232 seals across the relief port 229 of the tool body 202. When the sliding rod is retracted in the solenoid 231 in the open position, the second end 235 is removed from the relief port 229, such that fluid flows through the relief port 229 into an open end of the second end 235, and out the one or more ports 237 of the sliding rod 232. In the open position, the one or more ports 237 are aligned with the annulus relief port 230 and the port 211 in the sleeve housing 203, thereby by allowing fluid from the bore 205 to vent out of the downhole tool 200, as indicated by arrow 254.

Referring again to FIGS. 3A-3C and 4A-4C, the downhole tool 200 also includes an electronics package 213 disposed on the tool body 202. The electronics package 213 may include sensors, a power source, and electronics for a telemetry system including, for example, a processor and associated circuitry, which acts following programmed instructions, transducers, and receivers. The electronics package 213 may include standard MWD and logging-while-drilling (LWD) electronics known to those skilled in the art. The electronics used are generally designed to withstand high temperature environments (approximately 120° C.-175° C.), shock, and vibration. The power source may include one or more batteries 217. Batteries 217 may be lithium-thionyl chloride batteries to provide the required run time and to withstand high temperatures.

The electronics package 213 may also include one or more sensors 215. The one or more sensors 215 may be responsive to a downlink signal from the surface or may be configured to determine or measure downhole parameters. The electronics package 213 may include the annular pressure sensor 207. The downhole tool 200 may include one or more magnetometers or gyro sensors coupled to a circuit board in the electronics package 213 to sense or determine a rotational speed of the drill string (not shown). The downhole tool 200 may also include a temperature sensor coupled to a circuit board in the electronics package 213 to determine a downhole temperature. The downhole tool 200 may also include an accelerometer coupled to a circuit board in the electronics package 213 to sense a shock perceived by the downhole tool 200. The electronics package 213 may also include equipment to determine and record status parameters such as battery voltage, operating current, tool cycles, and operating time. Further, the electronics package 213 may include a programmable logic controller (PLC) 214 to drive an operating sequence of the downhole tool, including activating the downhole tool 200 and operating the valve actuation mechanism 212 and the pressure relief mechanism 209. The PLC 214 may include memory storing input data and control programs, an input and output interface, a communications interface to receive and transmit data on communication networks from/to remote PLCs (e.g., in valve actuation mechanism 212, pressure relief mechanism 209, or valves), a power supply, and a processor, which may interpret inputs, execute the control programs, and send output signals.

The electronics package 213 is configured such that the downhole tool 200 is self-powered. The electronics package 213 is electrically coupled to the valve actuation mechanism 212 and the pressure relief mechanism 209. During normal operations, the downhole tool 200 is dormant until activated. The downhole tool 200 is activated via downlinking from the surface. Specifically, the downhole tool 200 turns on when the downhole tool 200 receives a downlink signal to turn on. Sensors in the downhole tool 200 are configured to respond to surface commands (the downlink signal). The surface commands may be sent through variations in fluid flow rate, e.g., by manipulating surface pumps, manipulations of the drill string rotational speed (e.g., increase or decrease of rotations per minute (RPM)), RFID tags, or combinations of these. The instruction of the downlink may be coded by the time of high flow rate levels and low flow rate levels or by specific tool on/off sequences.

The downhole tool 200 may detect these signals by using a sensor that measures, for example, direct internal bore pressure. In other embodiments, the downhole tool 200 may detect the downlink signals at a programmed shaft rotational speed (RPM) if there is a turbine or similar device in the downhole tool 200. In other embodiments, a magnetometer or gyro sensor in the downhole tool 200 may sense variations in the drill string rotational speed. In still other embodiments, the downhole tool 200 may have one or more RFID readers configured to sense and read information on an RFID tag that is dropped from the surface and pumped past the downhole tool 200 with specific codes embedded in each tag. A combination of one or more of these downlink methods may be used. For example, the downhole tool 200 may include magnetometers or a gyro sensor in the downhole tool 200 to detect rotational speed and a bore pressure sensor to detect changes in the internal bore pressure. The surface rotational speed of the drill string is varied with a specific pattern of rotational speed and time spent at each speed, as shown in FIG. 2. The sensors in the downhole tool 200 are then set to activate the downhole tool 200 when the specific pattern is detected. Activating the downhole tool 200 may include activating the valve actuation mechanism 212 to close the bore and activating the pressure relief mechanism 209. Activating the downhole tool may also include activating the tool to take annular pressure measurements with the annular pressure sensor 207 and transmitting the annular pressure to the surface via the pressure relief mechanism 209. To differentiate a downlink from normal drilling activities, the drill string rotational speed patterns are different and may include, for example, a number of high speed pulses, different upper and lower limit thresholds, or varied timing. The bore pressure may be used as a safety lock to prevent accidental activation of the downhole tool 200, such that activation may occur only at a programmed bore pressure. Thus, a pump flow rate may be varied at the surface to change the bore pressure in the downhole tool 200. Alternatively, surface pumps may be varied between low flow, high flow, and mid flow at specific intervals or patterns to provide a downlink signal to the downhole tool 200 to activate.

In accordance with one or more embodiments, once the downhole tool 200 detects the downlink signal to turn on the downhole tool 200, the PLC 214 may control the sequence of operations such that a signal is sent to the valve actuation mechanism 212 to close the ball valve 206. Upon confirmation that the ball valve 206 has closed, the downhole tool 200 may then activate the pressure relief mechanism 209 to provide a pulsing sequence of negative pressure pulse signals to the surface to indicate the annular pressure measured or determined by the annular pressure sensor 207. If the ball valve 206 does not properly operate, such that the ball valve 206 does not close or does not fully close, a signal will not be sent to the PLC 214 and the PLC 214 will not activate the pressure relief mechanism 209 as a fail safe.

The downhole tool 200 can make measurements, such as annular pressure, temperature, bore pressure, etc. using one or more of the sensors coupled to the tool body 202 or within the electronics package 213 and send a signal back to the surface indicative of the measurement. The electronics package 13 may be configured to receive data from one or more sensors and convert the data to a signal to activate the valve actuation mechanism or the pressure relief mechanism, or to transmit a signal to the surface of the well indicative of a measured or determined downhole parameter. In one or more embodiments, annular pressure is measured and transmitted to the surface in realtime. A sensor or transducer may be located on the rig standpipe (not shown) to detect the signal returned by the downhole tool 200. In accordance with one or more embodiments disclosed herein, the signal returned by the downhole tool 200 is a negative pressure mud pulse signal.

Figure 14:
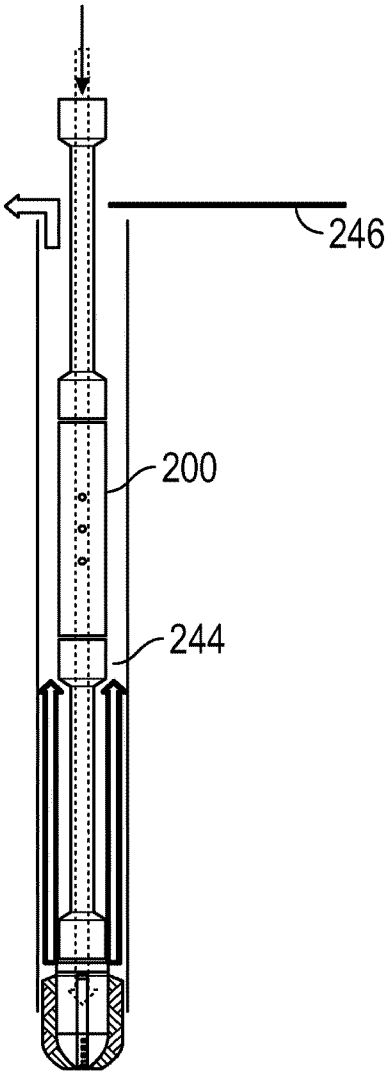
FIG. 14 is a front view of a bottomhole assembly in a wellbore while drilling in accordance with embodiments disclosed herein.
Figure 13:
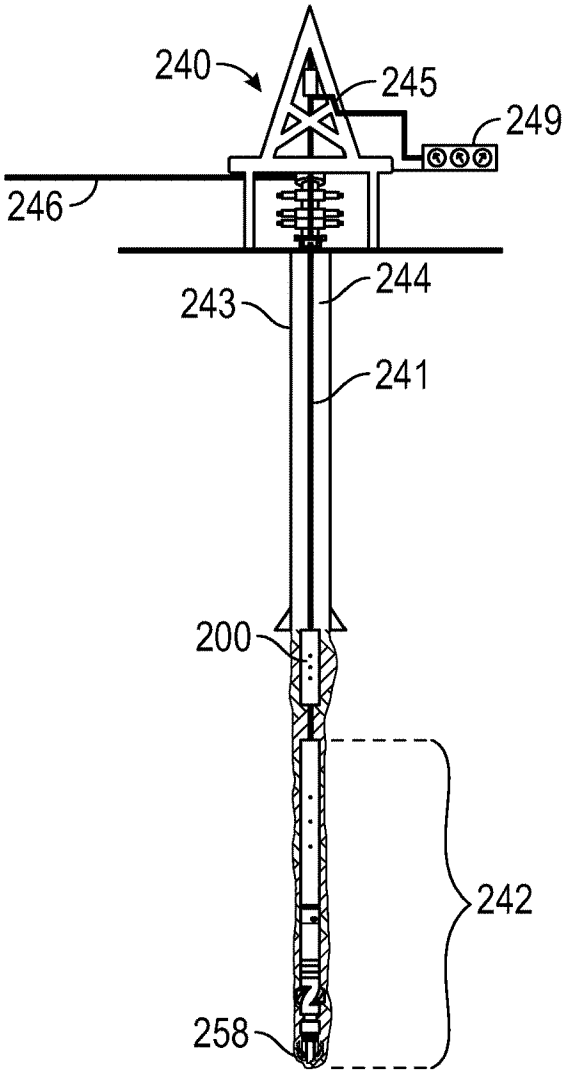
FIG. 13 is a schematic of a drilling rig and a drill string with a downhole tool in a wellbore while drilling in accordance with embodiments of the present disclosure.

Referring now to FIGS. 13-19, the operational sequence of drilling a well with a downhole tool in accordance with embodiments disclosed herein is shown and described. FIG. 13 shows a schematic of a drilling rig 240 with a drill string 241, the downhole tool 200, and a bottomhole assembly 242 in a well 243 while drilling. The bottomhole assembly 242 includes a drill bit 258. During drilling, fluid is pumped down the drill string 241 and exits out of the drill bit 258 (as shown in FIG. 14). The fluid (drilling mud) is then circulated back out of the well 243 up through the annulus 244 to the surface, removing cuttings from the well 243. During normal drilling, the fluid flow in is approximately equal to the fluid flow out. The stand pipe (located at 245) pressure (total pressure loss in the system) and the fluid level of the annulus (indicated at 246) is as expected for a particular drilling operation.

Figure 15:
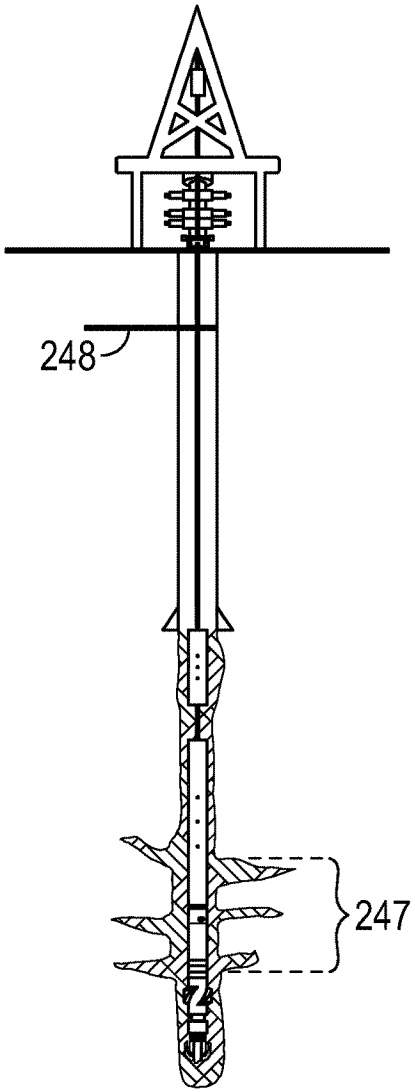
FIG. 15 a schematic of a drilling rig and a drill string with a downhole tool in a wellbore with fluid losses into a formation in accordance with embodiments of the present disclosure.
Figure 16:
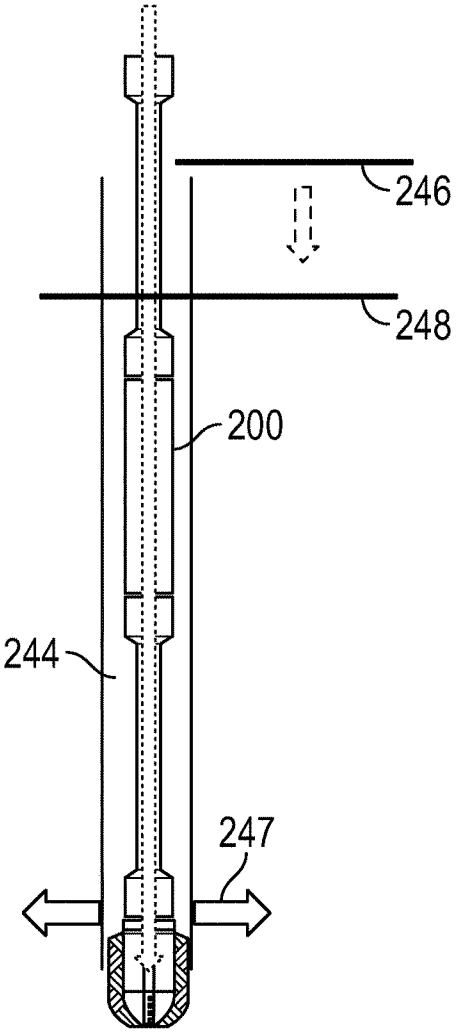
FIG. 16 is a front view of a bottomhole assembly in a wellbore with fluid losses into a formation in accordance with embodiments disclosed herein.

Referring to FIGS. 15 and 16, during a lost circulation event, when fluid is lost to the formation (indicated at 247), the fluid flow into the drill string is greater than the fluid flow out of the annulus and the fluid level in the annulus drops (indicated at 248). In severe lost circulation events, there may be no returned fluid to the surface. As a result, the stand pipe pressure drops. Gauges 249 at the surface on the rig monitor the stand pipe pressure, the fluid flow into drill pipe, and the fluid flow out of the annulus at the surface to detect any lost circulation event.

Figure 17:
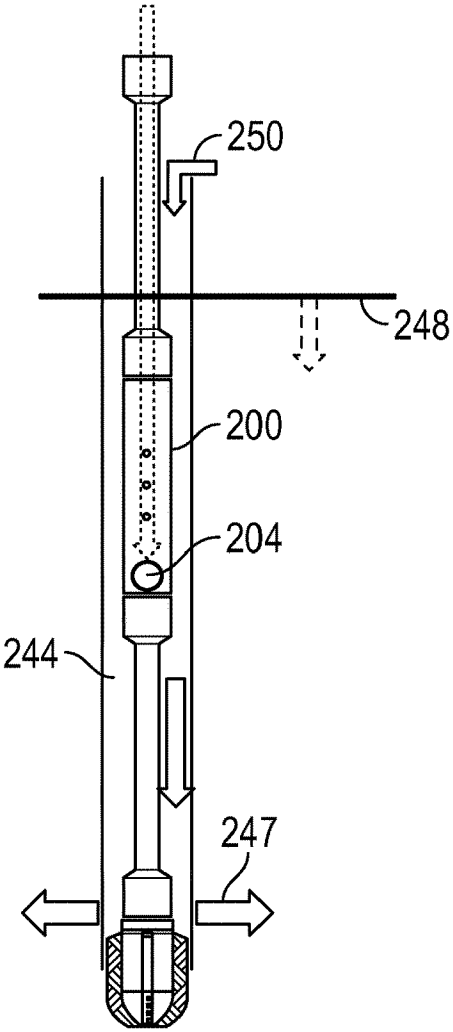
FIG. 17 is a front view of a bottomhole assembly in a wellbore with fluid losses into a formation and fluid flow into the drill string and the annulus in accordance with embodiments disclosed herein.

Referring to FIG. 17, once a lost circulation event is detected, pumps at the surface pumping fluid into the drill string may be turned off, and fluid may be pumped (indicated at 250) into the annulus 244 to maintain a sufficient fluid level 248 in the well. In accordance with the present disclosure, a surface downlink is then sent down to the downhole tool 200 to activate the downhole tool 200 and close the bore isolation valve 204, thereby closing the bore 205 (FIG. 3C) of the downhole tool 200 and the drill string 241 (FIG. 13). The surface downlink may be any downlink discussed above such that the downhole tool 200 receives a signal to turn on and close the bore isolation valve 204. The bore isolation valve 204 may be closed as discussed above, by activating the valve actuation mechanism 212 and rotating ball valve 206 (FIG. 3C). Subsequently, pressure in the drill string 241 is increased by filling the drill string 241 with drilling mud from the surface and holding pressure steady in the stand pipe 245 (FIG. 13), thereby trapping fluid in the bore of the drill string. Fluid may also be pumped into the annulus 244 to keep the well full.

Figure 18:
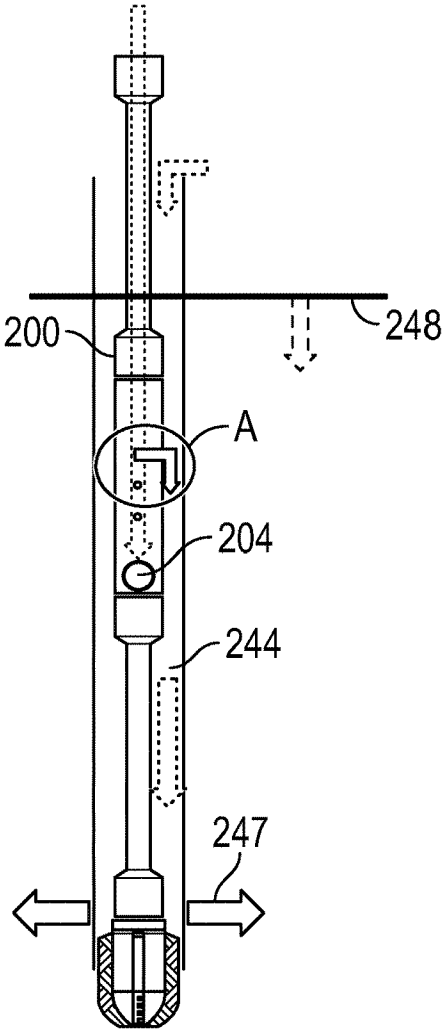
FIG. 18 is a front view of a bottomhole assembly in a wellbore with fluid vented from a pressure relief mechanism of a downhole tool in accordance with embodiments disclosed herein.
Figure 19:
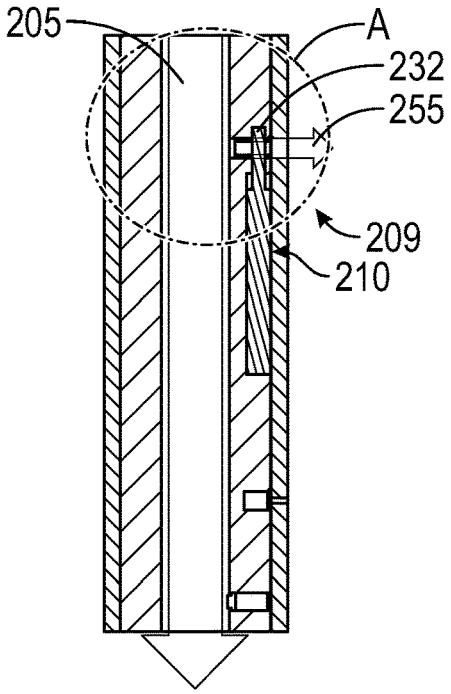
FIG. 19 is a close up view of Detail A of FIG. 18 showing the pressure relief mechanism of the downhole tool in accordance with embodiments disclosed herein.

Next, with the downhole tool 200 active, the downhole tool 200 vents small volumes of fluid through the pressure relief mechanism 209, as shown in FIGS. 18 and 19. Specifically, with the bore 205 closed by the bore isolation valve 204 and full of drilling mud, the diverter valve 210 is actuated to move the sliding rod 232 to provide fluid flow from the bore 205 of the downhole tool 200 to the annulus 244 (indicated by arrow 255). As discussed above, once the downhole tool 200 receives the surface downlink with a signal to turn on the downhole tool 200, electronics package 213 processes the signal and sends signals to the valve actuation mechanism 212 to close the bore isolation valve 204 and to the pressure relief mechanism 209 to activate the pressure relief mechanism (to open and close the diverter valve 210) to provide a pulsing sequence of negative pressure pulse signals to the surface according preprogrammed logic, for example, in the PLC 214. The pulsing sequence of negative pressure pulse signal provided by the pressure relief mechanism 209 thereby relays annular pressure data as measured by the annular pressure sensor 207, and as coded by the electronics package 213, to the surface through electronics-controlled actuation of the pressure relief mechanism 209.

Figure 20:
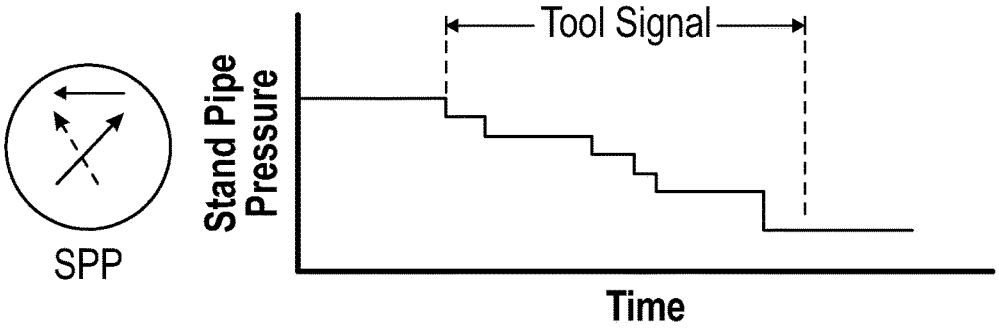
FIG. 20 is a representative graph showing stand pipe pressure versus time as fluid is vented from a downhole tool bore to an annulus in accordance with embodiments disclosed herein.

Fluid flow from the closed bore of the downhole tool 200 to the annulus creates a pressure drop in the drill string 241 and therefore provides a negative pressure pulse signal up through the drill string to the surface. Thus, the downhole tool 200 provides negative pulse telemetry without continuous fluid flow through the drill string. The negative pressure pulse signal is generated and controlled by the electronics package 213 (FIG. 3B) based on pressure measurements detected by the annular pressure sensor 207 (FIG. 3C). The electronics package 213 controls the opening and closing of the pressure relief mechanism 209 such that the measured downhole annular pressure is encoded in the resultant negative pressure pulses. Sensors in the stand pipe 245, such as pressure sensors, monitor and detect pressure pulse signals in the drill string fluid (as shown in FIG. 20) and a computer coupled to the rig decodes data received from the sensors to provide operators with the measured annular pressure in realtime. The annular pressure is monitored and hydrostatic head values may be calculated to determine any remedial actions. If depth of the downhole tool 200 and mud weight are known, then the annular pressure value can be used to calculate a height of an annular fluid column in the well, and therefore a top of fluid column in the well can be determined.

In some embodiments, a surface downlink may be sent that would signal only operation of the valve actuation mechanism 212 to close the bore isolation valve 204. In this manner, the surface downlink would activate the tool to function as a bore isolation tool, without activating the pressure relief mechanism. In other words, the electronics package 213 may be programmed to interpret different surface downlinks to activate different components or implement different sequences of operations to signal activation of one or more of the valve actuation mechanism 212 and the pressure relief mechanism 209.

As one of ordinary skill in the art will appreciate, MWD signals are sent in binary code made up of bits, words and frames. A bit is an individual 1 or 0, a word is a number of bits that make up that particular data point. For example, 14 bits may be required to send annular pressure and a number of words make up a frame. A surface acquisition system decodes the bits and aligns them with a frame allocating the bits to particular words. In some embodiments, time between pulses may be used to determine a value of the coded signal indicating annular pressure instead of binary code. For example, pressure is vented through the diverter valve 210 by the pressure relief mechanism 209 for a number of seconds which corresponds to measured or determined annular pressure and then the diverter valve 210 is closed again.

Figure 21:
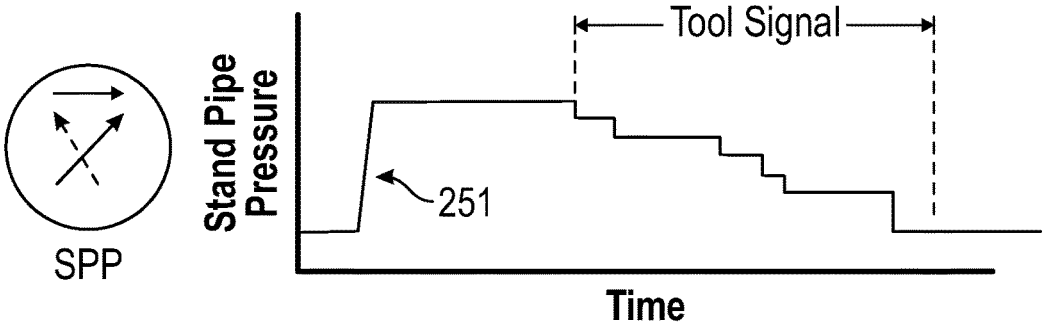
FIG. 21 is a representative graph showing stand pipe pressure versus time as fluid is vented from a downhole tool bore to an annulus and fluid is added into the drill string in accordance with embodiments disclosed herein.

As the downhole tool 200 continues to operate, and the pressure relief mechanism opens and closes to vent fluids from the bore 205 to the annulus 244, the stand pipe pressure will decrease with time. Accordingly, mud may be added periodically to the drill string to maintain a desired stand pipe pressure so that the stand pipe sensors continue to receive the negative pressure pulse signals. FIG. 21 shows an example of the stand pipe pressure over time and an increase in the stand pipe pressure (at 251) when the bore 205 of the drill string is re-pressurized to maintain signal quality (e.g., to adjust for vented fluid). If monitoring is no longer required, for example, if pressure is maintained in the annulus and the loss of fluid to the formation is stopped, a downlink signal may be sent to the downhole tool 200 to open the bore isolation valve 204 and deactivate the downhole tool 200, and normal drilling operations may be resumed. The downhole tool 200 is configured such that it may be activated, deactivated, and reactivated multiple times, and thus the above operational sequence may be repeated.

Figure 22:
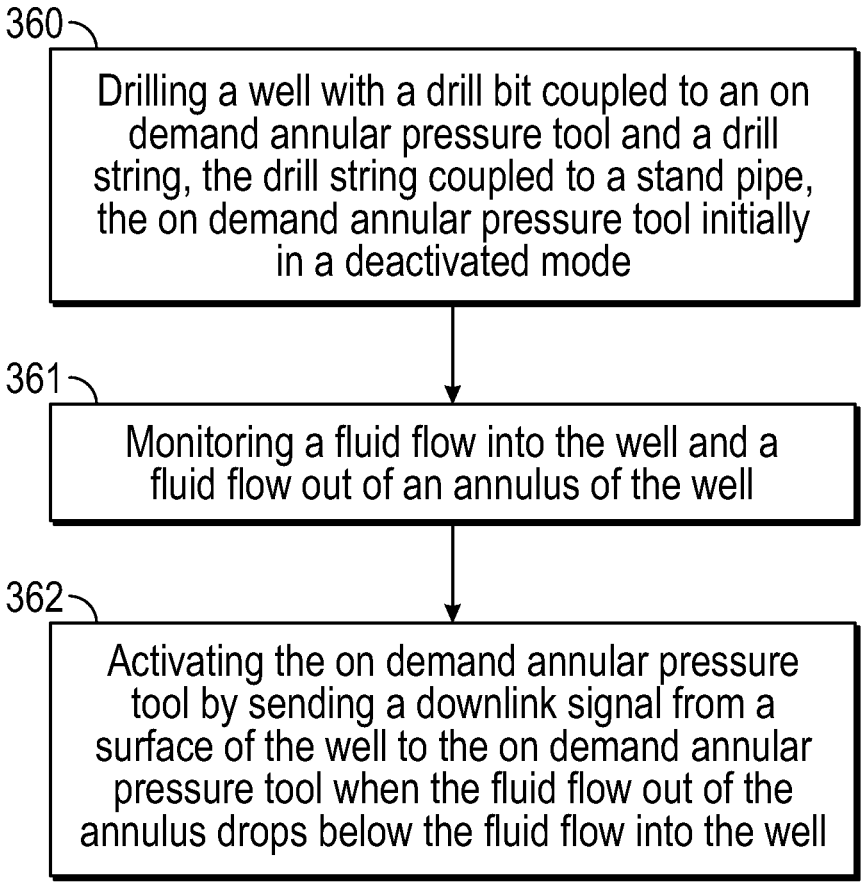
FIG. 22 shows a method of operating a downhole tool in accordance with embodiments disclosed herein.

Referring to FIG. 22, in accordance with one or more embodiments disclosed herein, a method may include drilling a well with a drill bit coupled to an on demand annular pressure tool and a drill string, shown at 360. The drill string is coupled to a stand pipe on the drilling rig. The on demand annular pressure tool is initially in a deactivated mode or dormant mode. The method further includes monitoring fluid flow into the well and fluid flow out of an annulus of the well, shown at 361. The on demand annular pressure tool is activated by sending a downlink signal from a surface of the well to the on demand annular pressure tool when the fluid flow out of the annulus drops below the fluid flow into the well a given amount, shown at 362.

Figure 23:
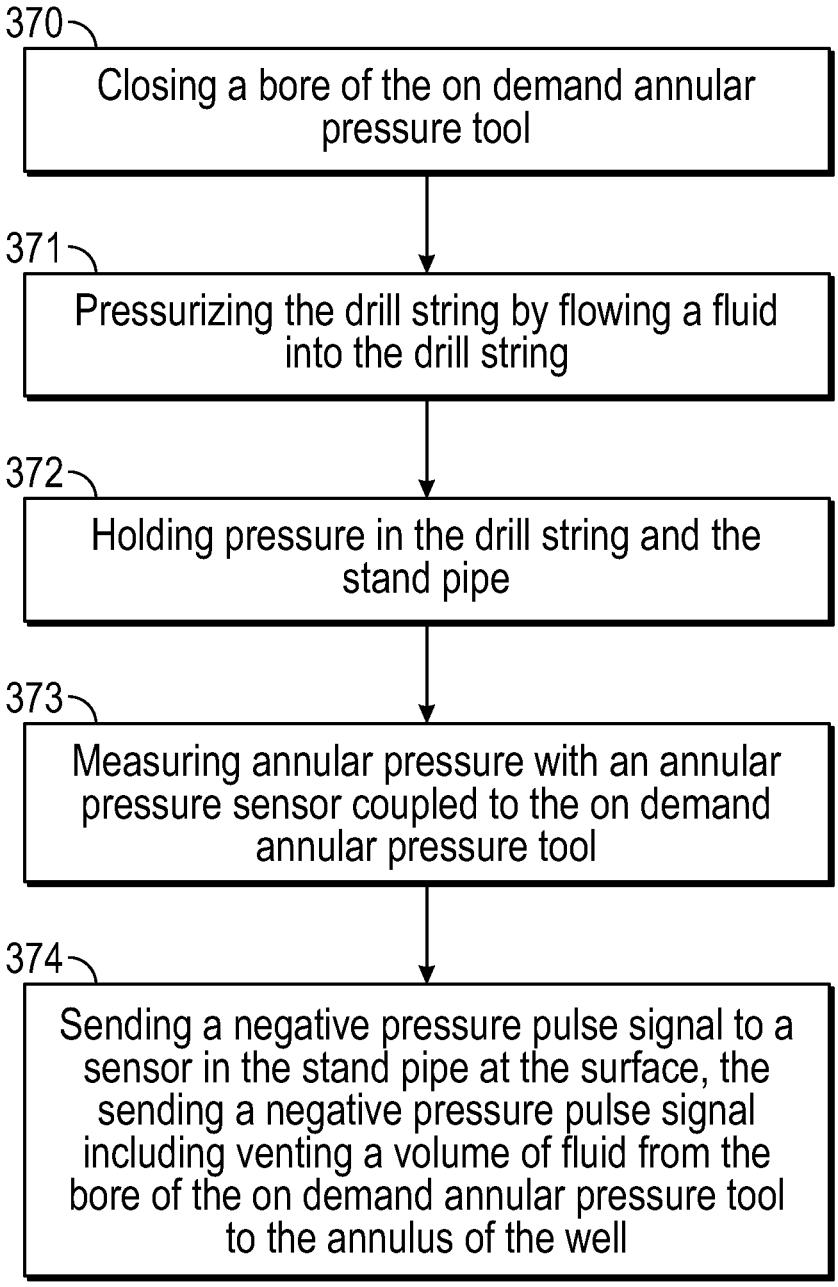
FIG. 23 shows a method of operating a downhole tool in accordance with embodiments disclosed herein.

Referring to FIG. 23, activation of the on demand annular pressure tool may include closing a bore of the on demand annular pressure tool (370), pressurizing the drill string by flowing a fluid into the drill string (371), holding pressure in the drill string and stand pipe (372), measuring annular pressure with an annular pressure sensor coupled to the on demand annular pressure tool (373), and sending a negative pressure pulse signal indicative of the annular pressure to a sensor in the stand pipe at the surface (shown at 374). Closing the bore of the on demand annular pressure tool may include electrically actuating a valve actuation mechanism to close a ball valve and sealing off the bore of the on demand annular pressure tool. Sending a negative pressure pulse signal includes venting a volume of fluid from the bore of the on demand annular pressure tool to an annulus of the well (shown at 374).

The annulus of the well may be filled by pumping fluid from the surface into the annulus. The fluid level of the annulus may be maintained by filling the annulus as needed. Venting the volume of fluid from the bore of the on demand annular pressure tool to an annulus of the well may include electrically actuating a solenoid disposed on the on demand annular pressure tool and moving a sliding rod of the solenoid from a closed position to an open position. In the open position, a bore port of the on demand annular pressure tool is in fluid communication with an annulus port of the on demand annular pressure tool. The drill string may be further re-pressurized to account fluid vented out of the annular pressure tool.

The on demand annular pressure tool may be deactivated with a downlink signal to the on demand annular pressure tool and reactivated with a downlink signal to the on demand annular pressure tool.

Figure 24:
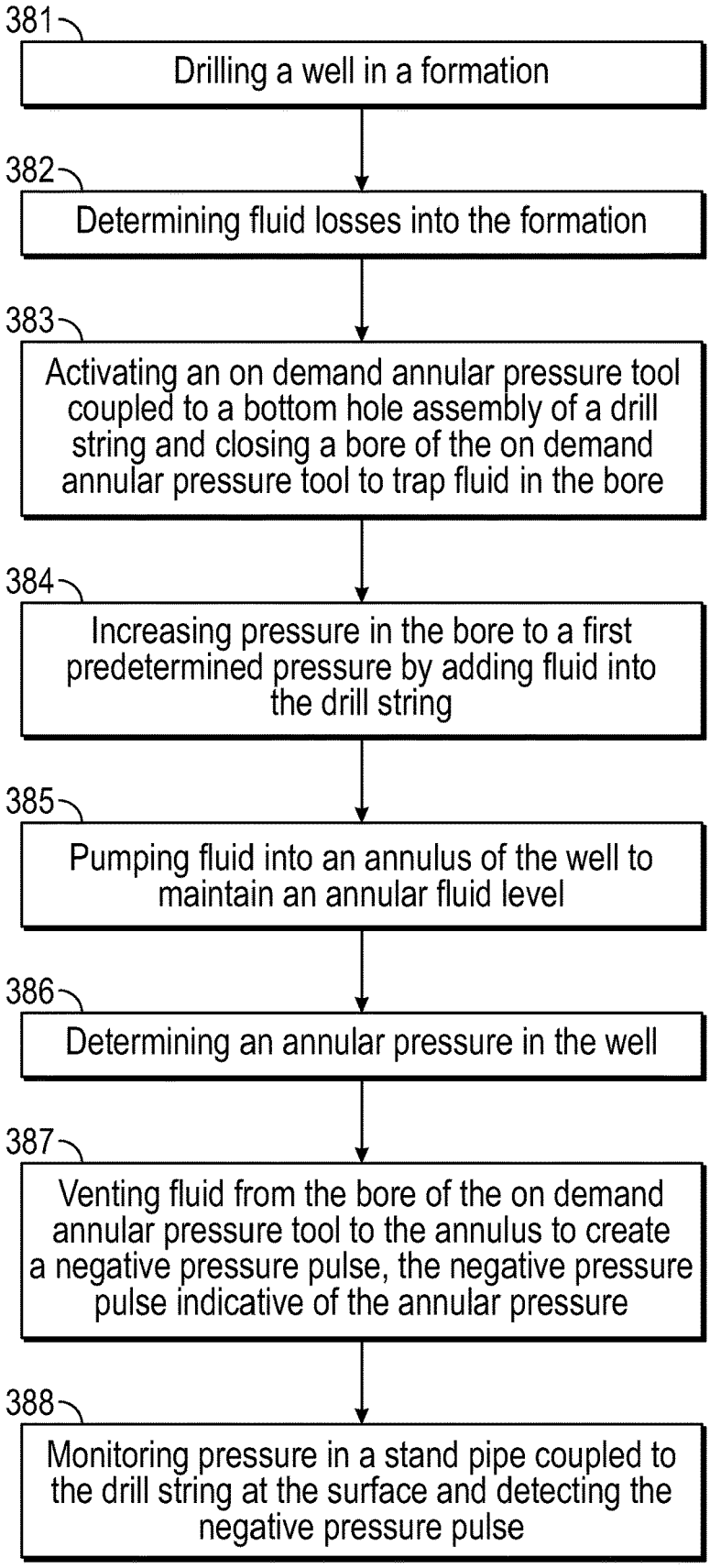
FIG. 24 shows a method of operating a downhole tool in accordance with embodiments disclosed herein.

Referring to FIG. 24, in one or more embodiments, a method according to the present disclosure may include drilling a well in a formation (381), determining fluid losses into the formation (382), activating an on demand annular pressure tool coupled to a bottom hole assembly of a drill string, and closing a bore of the on demand annular pressure tool to trap fluid in the bore (383). Pressure in the bore may then be increased to a first predetermined pressure by adding fluid into the drill string (384). Fluid may also be pumped into an annulus of the well to maintain an annular fluid level (385). The method also determining an annular pressure in the well (386) and venting fluid from the bore of the on demand annular pressure tool to the annulus to create negative pressure pulse in the fluid trapped in the bore (387). The annular pressure in the well is determined by and annular pressure sensor on the on demand annular pressure tool. The negative pressure pulse is indicative of the annular pressure measured in the well by annular pressure sensor on the on demand annular pressure tool. Pressure in a stand pipe coupled to the drill string at the surface is monitored to detect the negative pressure pulse (388). The negative pressure pulse may then be decoded at the surface to determine the downhole annular pressure in realtime.

Embodiments of the present disclosure may provide at least one of the following advantages. Embodiments disclosed herein provide a downhole tool that can be actuated and send negative pulse signals to the surface without the need to continuously pump mud at high flow rates. Thus, a downhole tool in accordance with the present disclosure may provide real time annular pressures during lost circulation events, without the need for fluid flow through the drill string. Additionally, the fluid level in the annulus may be determined for primary well verification. Further, a downhole tool in accordance with the present disclosure allows for telemetry between the downhole tool and the surface without the need for expensive wired drill pipe or acoustic systems. Moreover, the downhole tool can be used in any type of formation since the telemetry pulses are sent through the mud in the drill string and not through the formation.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plusfunction clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed:

1. A downhole tool comprising:

a tool body having a bore;

a bore isolation valve disposed in the tool body;

a sensor configured to receive to a downlink signal, the sensor coupled to the tool body;

an annular pressure sensor coupled to the tool body and configured to determine an annular pressure;

a valve actuation mechanism coupled to the bore isolation valve, the valve actuation mechanism responsive to the downlink signal;

a pressure relief mechanism disposed in the tool body and configured to provide a negative pressure pulse signal indicative of the annular pressure by venting fluid from the bore of the tool body to outside the tool body, the pressure relief mechanism responsive to the downlink signal; and a battery disposed on the tool body for powering the valve actuation mechanism and the pressure relief mechanism.

2. The downhole tool of claim 1, further comprising an electronics package disposed on the tool body and electrically coupled to the valve actuation mechanism and the pressure relief mechanism, the electronics package configured to convert data received from one or more sensors to a signal to activate the valve actuation mechanism or the pressure relief mechanism.

3. The downhole tool of claim 2, wherein the electronics package comprises at least one of a group consisting of a temperature sensor and an accelerometer.

4. The downhole tool of claim 1, wherein the pressure relief mechanism comprises a diverter valve comprising a solenoid with a sliding rod disposed in the tool body.

5. The downhole tool of claim 4, wherein the sliding rod of the solenoid is configured to move to open and close fluid communication between a bore port of the tool body and an annulus port of the tool body.

6. The downhole tool of claim 1, wherein the bore isolation valve is a ball valve configured to close the bore of the tool body.

7. The downhole tool of claim 6, wherein the ball valve is coupled to a ball valve housing disposed in the tool body, and wherein the ball valve is electrically actuated.

8. The downhole tool of claim 1, wherein the sensor responsive to a downlink signal comprises at least one selected from a group consisting of a bore pressure sensor, a magnetometer, and a gyro sensor.

* * * * *